US008423208B2

(12) United States Patent
Daum et al.

(10) Patent No.: US 8,423,208 B2
(45) Date of Patent: Apr. 16, 2013

(54) RAIL COMMUNICATION SYSTEM AND METHOD FOR COMMUNICATING WITH A RAIL VEHICLE

(75) Inventors: Wolfgang Daum, Erie, PA (US); Joseph Noffsinger, Grain Valley, MO (US); John Brand, Melbourne, FL (US); Jared Klineman Cooper, NE Palm Bay, FL (US); Todd Goodermuth, Melbourne, FL (US); Mark Kraeling, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 322 days.

(21) Appl. No.: 12/891,925

(22) Filed: Sep. 28, 2010

(65) Prior Publication Data

US 2012/0078452 A1 Mar. 29, 2012

(51) Int. Cl.
*H04B 3/54* (2006.01)
*B61L 3/20* (2006.01)

(52) U.S. Cl.
USPC ..... 701/19; 246/34 R

(58) Field of Classification Search ..... None
See application file for complete search history.

(56) References Cited

U.S. PATENT DOCUMENTS

| | | | | |
|---|---|---|---|---|
| 4,081,160 | A * | 3/1978 | Devy et al. | 246/63 C |
| 6,463,367 | B2 * | 10/2002 | Neff | 701/19 |
| 6,830,224 | B2 * | 12/2004 | Lewin et al. | 246/167 R |
| 6,856,865 | B2 | 2/2005 | Hawthorne | |
| 7,076,343 | B2 | 7/2006 | Kornick et al. | |
| 7,143,017 | B2 | 11/2006 | Flynn et al. | |
| 7,257,471 | B2 | 8/2007 | Kornick et al. | |
| 7,336,156 | B2 * | 2/2008 | Arita et al. | 340/12.32 |
| 7,653,465 | B1 | 1/2010 | Geiger et al. | |
| 2005/0143868 | A1 | 6/2005 | Whelan | |
| 2006/0170285 | A1 | 8/2006 | Morimitsu | |
| 2008/0033605 | A1 * | 2/2008 | Daum et al. | 701/19 |

(Continued)

FOREIGN PATENT DOCUMENTS

| | | | |
|---|---|---|---|
| EP | 1693272 | A1 * | 8/2006 |
| EP | 1897781 | | 3/2008 |

OTHER PUBLICATIONS

ISR and Written Opinion for International Application No. PCT/US2011/036159 dated Aug. 30, 2011.
ISR and Written Opinion for International Application No. PCT/US2011/042476 dated Aug. 31, 2011.

*Primary Examiner* — Michael J Zanelli
(74) *Attorney, Agent, or Firm* — GE Global Patent Operation; John A. Kramer

(57) ABSTRACT

A rail communication system includes: a communication management device capable of being communicatively coupled with a conductive pathway that extends along a track; and an on-board communication device capable of being coupled with a rail vehicle that travels along the track and with the conductive pathway, the communication management device and the on-board communication device configured to communicate a data signal between each other through the conductive pathway, where the data signal includes network data. A method for communicating with rail vehicles includes: coupling a vehicle management device with a conductive pathway that extends alongside a track; and coupling an on-board communication device disposed on a rail vehicle that travels along the track with the conductive pathway; where the communication management device and the on-board communication device communicate a data signal that includes network data through the conductive pathway.

19 Claims, 9 Drawing Sheets

U.S. PATENT DOCUMENTS

2008/0159281 A1 7/2008 Jesseph
2010/0049830 A1 2/2010 Chenu
2010/0241295 A1 9/2010 Cooper
2010/0332058 A1* 12/2010 Kane et al. ..... 701/20

* cited by examiner

RAIL COMMUNICATION SYSTEM AND METHOD FOR COMMUNICATING WITH A RAIL VEHICLE

CROSS-REFERENCE TO RELATED APPLICATIONS

This application is related to U.S. patent application Ser. No. 12/891,938, filed on Sep. 28, 2010, and entitled "Rail Appliance Communication System And Method For Communicating With A Rail Appliance" (the "'938 application") and U.S. patent application Ser. No. 12/891,936, filed on Sep. 28, 2010, and entitled "Rail Vehicle Control Communication System And Method For Communicating With A Rail Vehicle" (the "'936 application"). The entire subject matter of the '938 and the '936 applications are incorporated by reference herein. This application also claims priority to co-pending U.S. Provisional Patent Application No. 61/346,448, entitled "Communication System And Method For Rail Vehicle Consist," and filed on May 19, 2010, (the "'448 application"), and to co-pending U.S. Provisional Application No. 61/361,702, entitled "Communication System And Method For Rail Vehicle Consist," and filed on Jul. 6, 2010 (the "'702 application").

BACKGROUND

One or more embodiments of the subject matter described herein relate to data communications and, more particularly, to data communications with a rail vehicle.

Rail vehicles such as trains include propulsion systems that move the rail vehicles along a track. These propulsion systems may include engines, motors, and/or electric circuits that provide power to propel the rail vehicles along the track. The rail vehicles may include brakes that slow the movement of the rail vehicles.

Some known rail vehicles include software applications that automatically control a throttle of a rail vehicle (e.g., locomotive and/or train) based on a trip profile. For example, General Electric Company's Trip Optimizer™ energy management software application automatically controls a rail vehicle's throttle based on a trip profile in order to help keep the rail vehicle on schedule while reducing fuel use. The Trip Optimizer™ system creates a trip profile that can reduce braking of the rail vehicle by automatically learning the rail vehicle's characteristics and calculating an efficient way of running the rail vehicle by considering factors such as the length and weight of the rail vehicle, the grade of the route that the rail vehicle will be traversing, conditions of the track that the rail vehicle will be traveling along, weather conditions, and performance of the rail vehicle. During the trip, the propulsion subsystem is at least partially controlled by the Trip Optimizer™ system to propel the rail vehicle along its route according to the trip profile.

The trip profile may be communicated or downloaded to the rail vehicles when the rail vehicles are in a rail yard. In some known rail yards, the trip profile is downloaded using wireless transmission of data signals, such as radio frequency (RF) signals. The use of RF signals to communicate with the rail vehicles requires relatively costly equipment. Moreover, the wireless signals transmitted in rail yards located in urban or densely populated areas may be interfered with by other wireless signals transmitted in the area. The interference with the yard RF signals can cause interruption of communication with the rail vehicles and/or for data or information transmitted to the rail vehicles to not be delivered.

A need exists for an improved system and method for communicating with rail vehicles.

BRIEF DESCRIPTION

In one embodiment, a rail communication system includes: a communication management device capable of being communicatively coupled with a conductive pathway that extends along a track; and an on-board communication device capable of being coupled with a rail vehicle that travels along the track and with the conductive pathway, the communication management device and the on-board communication device capable of communicating a data signal between each other through the conductive pathway.

In another embodiment, a method for communicating with rail vehicles includes: coupling a vehicle management device with a conductive pathway that extends alongside a track; coupling an on-board communication device disposed on a rail vehicle that travels along the track with the conductive pathway; and communicating a data signal between the communication management device and the on-board communication device through the conductive pathway.

In another embodiment, a method for communicating with a rail vehicle is provided. The method includes transmitting a data signal from at least one of an on-board communication device disposed on the rail vehicle that travels along a track or a communication management device. The data signal includes network data and is transmitted over a conductive pathway that extends along the track. The method also includes receiving the data signal at the other of the on-board communication device and the communication management device and processing the data signal for one or more of management or control of movement of the rail vehicle along the track.

In another embodiment, a rail communication system includes: a management device capable of being communicatively coupled with a conductive pathway that extends along a rail that a plurality of rail vehicles travel along; and a communication device capable of being coupled with the rail and at least one of a wayside equipment assembly or a rail vehicle, the management device and the communication device capable of communicating a data signal between each other and through the conductive pathway to at least one of change a status of the wayside equipment assembly, control an operation of the rail vehicle, or communicate trip related information with the rail vehicle.

BRIEF DESCRIPTION OF THE DRAWINGS

The present invention will be better understood from reading the following description of non-limiting embodiments, with reference to the attached drawings, wherein below.

DETAILED DESCRIPTION

Figure 1:
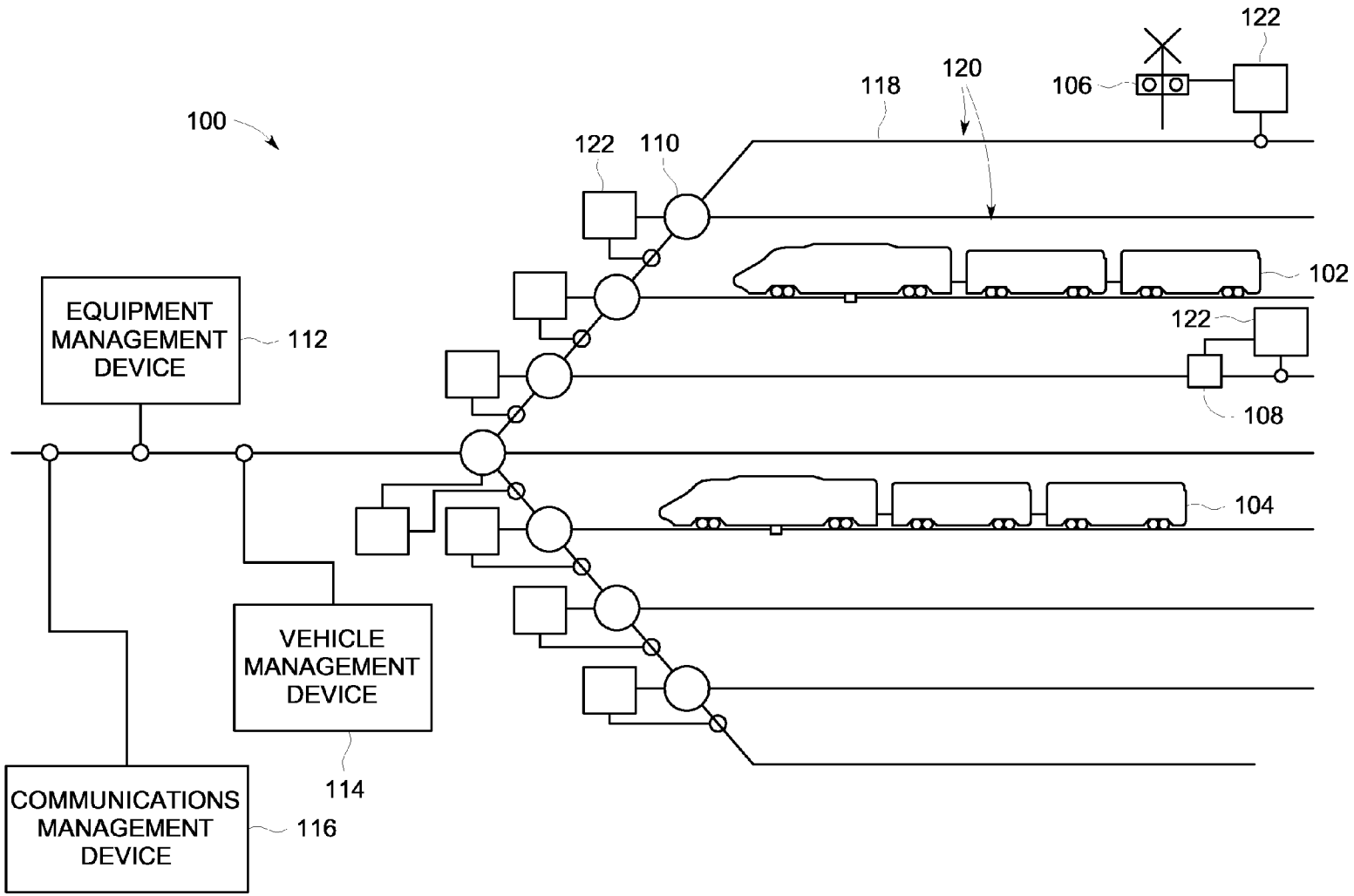
FIG. 1 is a diagram of a rail communication system in accordance with one embodiment.

At least one embodiment described herein provides for rail communication systems that transmit and/or receive data signals between rail appliances, rail vehicles, and management devices, with the data signals communicated through conductive pathways, such as one or more rails that the rail vehicles travel along or an overhead catenary. The data signals may comprise network data, such as packetized data that includes address fields indicating the transmitter and/or receiver of the data and data fields that represent information and/or instructions, for example. At least one technical effect of one or more embodiments described herein is the communication of data signals between a management device and a rail appliance through a conductive pathway such as a rail or catenary to control the rail appliance and/or to download information from the rail appliance, such as a position or sensor reading obtained by the rail appliance. One or more of the management device and the rail appliance (or a communication device coupled with the rail appliance) may be configured to process the data signals for management and/or control of the rail appliance.

Another technical effect of one or more embodiments described herein is the communication of data signals between a management device and a rail vehicle through a conductive pathway such as a rail or catenary to control operation of the rail vehicle, such as by remotely controlling the speed and/or braking of the rail vehicle. One or more of the management device and the rail vehicle (or a communication device coupled with the rail vehicle) may be configured to process the data signals for management and/or control of the rail vehicle and/or of a propulsion subsystem of the rail vehicle.

Another technical effect of one or more embodiments described herein is the communication of data signals between a management device and a rail vehicle through a conductive pathway such as a rail or catenary to upload vehicle management information related to an upcoming trip of the rail vehicle. For example, the management device may upload data signals that include information about the route that the rail vehicle will traverse during a future trip, with the information being uploaded to the rail vehicle through the rail and/or catenary. The rail vehicle (or a communication device coupled with the rail vehicle) may be configured to process the data signals for management and/or control of the rail vehicle and/or of a propulsion subsystem of the rail vehicle as the rail vehicle travels over the route during the trip. As another example, the rail vehicle may download data signals that include information about a previous trip of the rail vehicle, with the information being downloaded to the management device through the rail and/or catenary. The management device may be configured to process the data signals for review of the operation of the rail vehicle by an operator, such as by performing analysis of the data signals to determine if the operator followed applicable regulations and safety precautions, such as speed limits.

FIG. 1 is a diagram of a rail communication system 100 in accordance with one embodiment. The rail communication system 100 permits the communication of data signals with rail vehicles 102, 104 disposed on or traveling along tracks 120 and/or wayside equipment assemblies 106, 108, 110 (or rail appliances) disposed alongside or on the tracks 120. The data signals may be communicated to the rail vehicles 102, 104 and/or wayside equipment assemblies 106, 108, 110 from one or more of an equipment management device 112, a vehicle management device 114, and/or a communications management device 116. The management devices 112, 114, 116 may control communications with or between the rail vehicles 102, 104 and/or the wayside equipment assemblies 106, 108, 110. In one embodiment, the management devices 112, 114, 116 include one or more transceivers, modems, routers, and the like to electrically transmit and/or receive data signals. The management devices 112, 114, 116 may use one or more of a variety of communication protocols to transmit and receive the data signals. By way of example only, the management devices 112, 114, 116 may use one or more of the Transmission Control Protocol (TCP), Internet Protocol (IP), TCP/IP, User Datagram Protocol (UDP), or Internet Control Message Protocol (ICMP).

In one embodiment, the data signals are communicated through conductive pathways 118 that extend along the tracks 120. The tracks 120 may include one or more rails that the rail vehicles 120, 104 travel along. The conductive pathways 118 through which the data signals are communicated can be existing conductive members that are already present along the tracks 120. For example, the conductive pathways 118 may include one of the rails of the tracks 120 that wheels of the rail vehicles 102, 104 roll on, or a powered rail, such as a third rail, from which the rail vehicles 102, 104 draw electric current to power the rail vehicles 102, 104. In another embodiment, the conductive pathways 118 include catenaries 718 (shown in FIG. 7) that extend above or alongside the tracks 120 and supply electric current to the rail vehicles 102, 104 to power the rail vehicles 102, 104. The conductive pathways 118 may convey the data signals along one or more communication channels. For example, the conductive pathways 118 may include two or more rails extending parallel to each other along the tracks 120. Each rail may represent a single communication channel.

The data signals may be electrically communicated through the conductive pathways 118 as digital signals. By way of example only, the data signals may be transmitted using differential signals. For example, the data signals may be transmitted by applying a differential signal to the conductive pathways 118 of the tracks 120. The differential signal may be applied as a differential signal across or between the two rails of a track 120 having two conductive rails, across or between a rail of a track 120 and a ground reference, across or between a rail of the track 120 and another conductive body, such as the catenary 718 (shown in FIG. 7), or across or between the catenary 718 of the track 120 and another conductive body. Alternatively, the data signal may be communicated as a single-ended signal that is transmitted through one or more conductive pathways 118 of the track 120.

In another embodiment, the data signals may be communicated as analog signals, such as acoustic waves. For example, the data signals may be transmitted as sound waves that propagate through one or more of the conductive pathways 118. In another example, the data signals may propagate through the ground below the rail vehicles 102, 104.

The data signals are at least partially communicated in non-wireless manners to reduce the amount of wireless data traffic in and around the management devices 112, 114, 116, the rail vehicles 102, 104, and the wayside equipment assemblies 106, 108, 110. For example, the conductive pathways 118 may transmit the data signals similar to wired connections between the management devices 112, 114, 116, the rail vehicles 102, 104, and the wayside equipment assemblies 106, 108, 110. By using existing conductive pathways 118 for communicating data signals among the management devices 112, 114, 116, the rail vehicles 102, 104, and/or the wayside equipment assemblies 106, 108, 110, the communication system 100 may avoid or reduce interference and other problems associated with wireless transmissions of the data signals, and may obviate the need to specially outfit the management devices 112, 114, 116, the rail vehicles 102, 104, and/or the wayside equipment assemblies 106, 108, 110 with dedicated network cables or wireless transmission devices.

As described below, the data signals may be communicated to control operation of a rail vehicle 102, 104 and/or wayside equipment assembly 106, 108, 110. For example, instead of merely communicating a status or condition of one wayside equipment assembly 106, 108, 110 to another, the data signals may be used to control the wayside equipment assemblies 106, 108, 110. Alternatively, the data signals may be used to communicate a status or condition of a rail vehicle 102, 104 and/or wayside equipment assembly 106, 108, 110. In another example, the data signals may include information related to an upcoming trip of the rail vehicles 102, 104 or a previous trip of the rail vehicles 102, 104. The data signals may include updates to software applications of the rail vehicles 102, 104 and/or wayside equipment assemblies 106, 108, 110 and/or new software applications for the rail vehicles 102, 104 and/or wayside equipment assemblies 106, 108, 110.

Figure 2:
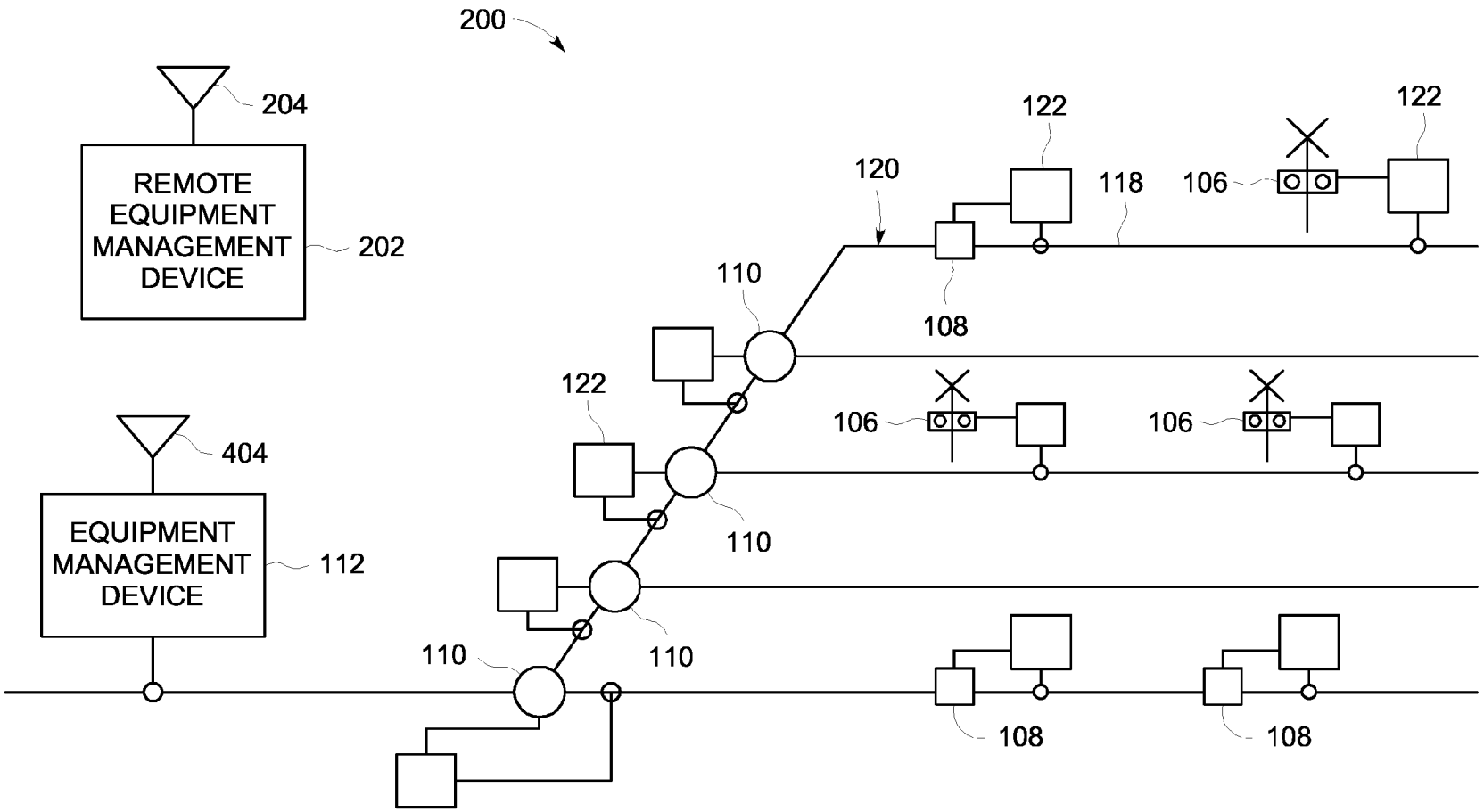
FIG. 2 is a diagram of a rail appliance communication system in accordance with one embodiment.

FIG. 2 is a diagram of a rail appliance communication system 200 in accordance with one embodiment. The rail appliance communication system 200 may be part of the rail communication system 100 (shown in FIG. 1). For example, the rail communication system 100 may include a system and associated components that provides for the communication of data signals between and among the management devices 112, 114, 116, the rail vehicles 102, 104, and the wayside equipment assemblies 106, 108, 110 (all shown in FIG. 1). The rail appliance communication system 200 may be a subset or subsystem of the rail communication system 100 in that the rail appliance communication system 200 provides for the communication of data signals between and among the equipment management device 112 and the wayside equipment assemblies 106, 108, 110.

In one embodiment, the equipment management device 112 communicates data signals with the wayside equipment assemblies 106, 108, 110 to remotely check on or change a status of the wayside equipment assemblies 106, 108, 110. The wayside equipment assemblies 106, 108, 110 include rail appliances and equipment located at or near the tracks 120 and that provide services to the rail vehicles 102, 104 and/or persons traveling near the rail vehicles 102, 104. By way of example only, the wayside equipment assembly 106 may include a track signal (e.g., device for controllably displaying one or more colored light aspects to passing vehicles), the wayside equipment assembly 108 may include a rail vehicle monitoring apparatus, and the wayside equipment assembly 110 may include a track switch. Alternatively, the wayside equipment assemblies 106, 108, 110 may include one or more other wayside appliances.

The equipment management device 112 can communicate with the wayside equipment assemblies 106, 108, 110 through the conductive pathways 118 to report or change a status of the wayside equipment assemblies 106, 108, 110. With respect to a track signal (such as the wayside equipment assembly 106), the state of the track signal may be whether one or more lights of the track signal is illuminated or if a barricade of the track signal is raised or lowered. The equipment management device 112 transmits control data signals via the conductive pathways 118 of the tracks 120 to the track signal to change the illuminated lights of the track signal and/or raise or lower the barricade of the track signal in one embodiment. The health of the track signal may be reported as the status of the track signal and indicate if one or more of the lights of the track signal are malfunctioning, unable to illuminate, or unable to be turned off. Alternatively, the health of the track signal may indicate if the barricade is unable to be raised or lowered. In another embodiment, the health may indicate the result of a self-diagnostic test that is performed by the track signal.

With respect to a rail vehicle monitoring apparatus (such as the wayside equipment assembly 108), the monitoring apparatus can include a sensor or detector that measures or samples one or more qualities of the rail vehicles 102, 104. For example, the monitoring apparatus may be a hot box detector that measures the temperatures or thermal energy of axles or wheels of the rail vehicles 102, 104. Alternatively, the monitoring apparatus may be another sensor that examines the rail vehicles 102, 104 to ensure continued safe operation of the rail vehicles 102, 104. Data signals may be conveyed between the equipment management device 112 and the monitoring apparatus through the conductive pathways 118 in order to communicate a state or health of the monitoring apparatus and/or the rail vehicles 102, 104. For example, the state of the monitoring apparatus may be whether the monitoring apparatus is activated or deactivated, the detection of an abnormality related to the rail vehicles 102, 104 (such as a hot axle or bearing), or the presence of the rail vehicle 102 or 104 at or near the monitoring apparatus. The health of the monitoring apparatus may indicate if the monitoring apparatus is functioning or the result of a self-diagnostic test that is performed by the monitoring apparatus.

In one embodiment, the equipment management device 112 may transmit a request to the monitoring apparatus via a data signal transmitted through the conductive pathways 118 of the tracks 120 to download or transmit one or more measurements obtained by the monitoring apparatus to the equipment management device 112. In response to the request, the appliance communication device 122 that is coupled with the monitoring apparatus may obtain the measurement from the monitoring apparatus or a local memory of the monitoring apparatus and report the measurement to the equipment management device 112.

With respect to a track switch (such as the wayside equipment assembly 110), the track switch can be disposed at intersections between two or more tracks 120, as shown in FIG. 1. The track switch alternates between different positions to couple or decouple two portions of the tracks 120 with each other and thereby allow the rail vehicles 102, 104 to travel along the two portions of the tracks 120. Data signals may be conveyed between the equipment management device 112 and the track switch through the conductive pathways 118 in order to report a state or health of the track switch. The state of the track switch can indicate the position of the track switch. For example, the state of the track switch may represent which two portions of the tracks 120 are currently coupled by the track switch such that the rail vehicles 102, 104 can travel therebetween through the track switch. In one embodiment, the equipment management device 112 transmits a request data signal through the conductive pathways 118 of the tracks 120 that directs the track switch to change positions. The health of the track switch may indicate if the track switch is functioning or the result of a self-diagnostic test that is performed by the monitoring apparatus. For example, the health of the track switch can indicate if the track switch is able to alternate between different positions to couple different portions of the tracks 120 with each other.

The wayside equipment assemblies 106, 108, 110 are communicatively coupled with appliance communication devices 122, such as by one or more wired or wireless connections. The appliance communication devices 122 are, in turn, coupled with the conductive pathways 118. For example, the appliance communication devices 122 may be coupled with one or more rails of the tracks 120 by wires, cables, or other conductive members. The appliance communication devices 122 communicate the data signals through the conductive pathways 118 with the equipment management device 112. The appliance communication devices 122 may include transceivers, modems, routers, and the like, to electrically transmit data signals to and/or receive data signals from the equipment management device 112. The appliance communication devices 122 can communicate the data signals as discrete data packets (referred to herein, on occasion, as "network data") that include blocks of data that are individually communicated with the equipment management device 112. For example, the appliance communication devices 122 can transmit and receive data packets using one or more of the TCP/IP, UDP, or ICMP protocols. However, other protocols may be used.

Figure 3:
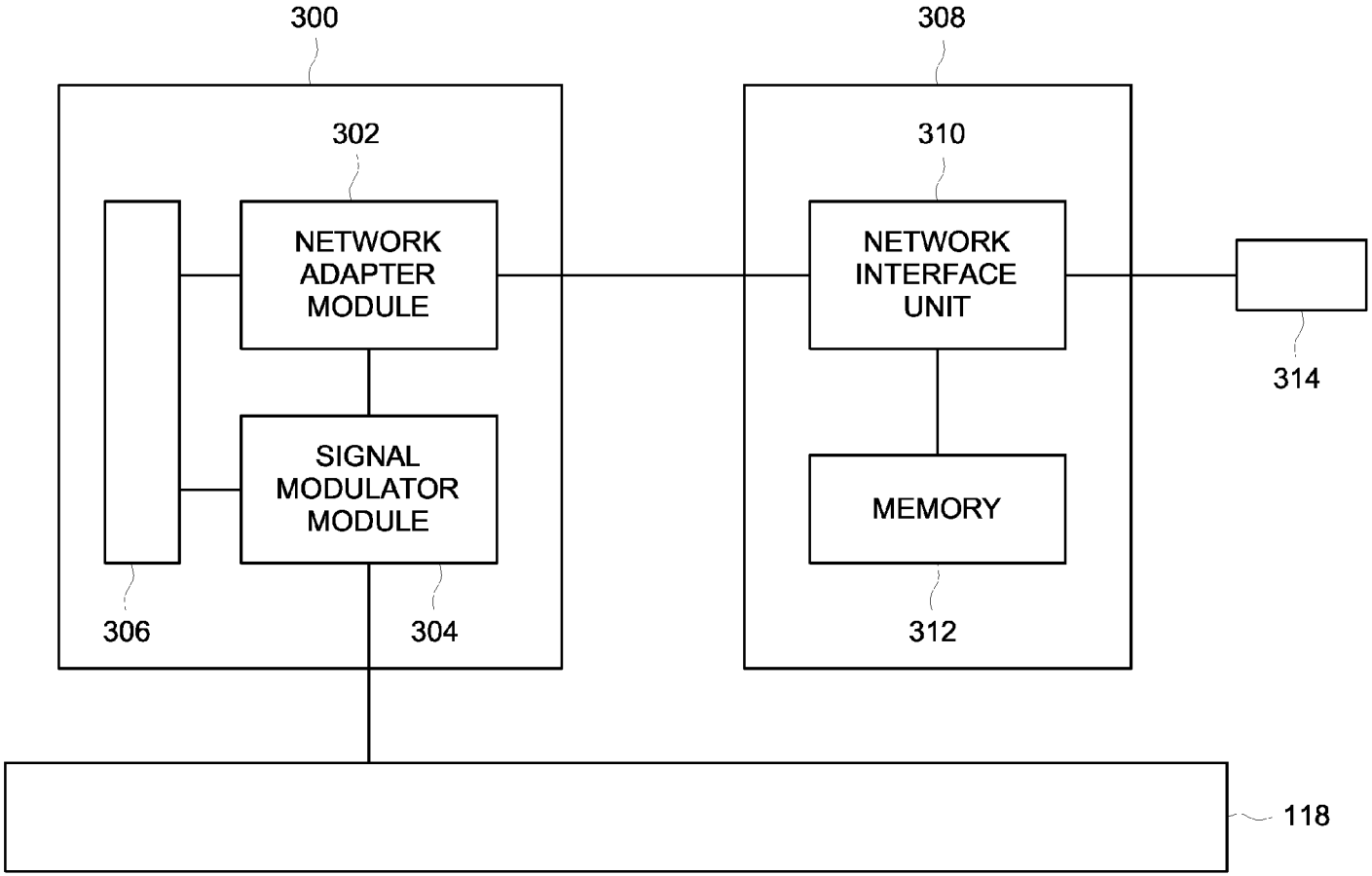
FIG. 3 is a diagram of a slave network interface assembly in accordance with one embodiment.

FIG. 3 is a diagram of a slave network interface assembly 300 in accordance with one embodiment. The slave network interface assembly 300 may be disposed within or coupled with the appliance communication device 122 to permit the appliance communication device 122 to transmit and/or receive data signals through the conductive pathway 118. The slave network interface assembly 300 includes a network adapter module 302 and a signal modulator module 304. The modules 302, 304 may include one or more processors, microprocessors, controllers, microcontrollers, or other logic devices that operate based on instructions stored on a tangible and non-transitory computer readable storage medium, such as software applications stored on a memory 306. Alternatively, the modules 302, 304 may operate based on hardwired instructions of the modules 302, 304. In one embodiment, the slave network interface assembly 300 includes or is embodied in a network interface card or network adapter.

The signal modulator module 304 is electrically coupled with the network adapter module 302 and the conductive pathway 118. The network adapter module 302 is electrically connected to a device interface unit 308. In one embodiment, the device interface unit 308 is disposed in or otherwise communicatively coupled with at least one of the wayside equipment assemblies 106, 108, 110 (shown in FIG. 1). The device interface unit 308 permits the wayside equipment assembly 106, 108, or 110 to communicate and interface with the slave network interface assembly 300 so that the slave network interface assembly 300 can transmit data signals representative of data from the wayside equipment assembly 106, 108, or 110 along the conductive pathway 118. Additionally, the device interface unit 308 may receive and convey data included in data signals received through the conductive pathway 118 to the wayside equipment assembly 106, 108, or 110. The device interface unit 308 may be embodied in or include a processor or controller, such as a computer processor or microcontroller.

The device interface unit 308 includes a network interface unit 310. The network interface unit 310 may be embodied in, or functionally connected to, one or more software or hardware applications stored on a tangible and non-transitory computer readable storage medium, such as a memory 312. In one embodiment, the network adapter module 302, the signal modulator module 304, and/or the network interface unit 310 include standard Ethernet-ready (or other network) components, such as Ethernet adapters.

In order to transmit data signals from the wayside equipment assembly 106, 108, or 110 (shown in FIG. 1) to the equipment management device 112 (shown in FIG. 1) and/or another wayside equipment assembly 106, 108, 110, the device interface unit 308 conveys data or instructions to the network adapter module 302 of the slave network interface assembly 300. The network adapter module 302 conveys the data or instructions to the signal modulator module 304, which modulates the data or instructions into modulated network data and transmits the modulated network data through the conductive pathway 118 as a data signal.

In order to receive data signals, the signal modulator module 304 receives data signals from the conductive pathway 118 and may de-modulate the data signals into network data, which is then conveyed to the network adapter module 302 for transmission to the network interface unit 310 of the device interface unit 308. One or both of the network adapter module 302 and the signal modulator module 304 may perform various processing steps on the data signals and/or the modulated network data for transmission and reception through the conductive pathway 118. Additionally, one both of the network adapter module 302 and the signal modulator module 304 may perform network data routing functions, such as by comparing an address included in a received data signal with a unique address associated with the slave network interface assembly 300 or the device interface unit 308.

The network interface unit 310 includes an external interface 314 that can be communicatively coupled with an external device in order to provide for communication between the external device and the conductive pathway 118. For example, the external interface 314 may be a wired connector, cable, or wireless antenna for communicating data signals with the wayside equipment assembly 106, 108, 110 (shown in FIG. 1).

The signal modulator module 304 may include an electrical output (for example, a port and/or wires) for electrical connection to the conductive pathway 118, and internal circuitry (for example, electrical and isolation components, microcontroller, software/firmware) for receiving network data from the network adapter module 302, modulating the network data into modulated network data, transmitting the modulated network data through the conductive pathway 118 as data signals, receiving data signals communicated through the conductive pathway 118, de-modulating the data signals into network data, and communicating the network data to the network adapter module 302. The internal circuitry may be configured to modulate and de-modulate data using schemes such as those utilized in VDSL or VHDSL (very high bitrate digital subscriber line) applications, or in power line digital subscriber line (PDSL) applications. One example of a suitable modulation scheme is orthogonal frequency-division multiplexing (OFDM). OFDM is a frequency-division multiplexing scheme wherein a large number of closely-spaced orthogonal sub-carriers are used to carry data. The data is divided into several parallel data streams or channels, one for each sub-carrier. Each sub-carrier is modulated with a conventional modulation scheme (such as quadrature amplitude modulation or phase shift keying) at a low symbol rate, maintaining total data rates similar to conventional single-carrier modulation schemes in the same bandwidth. The modulation or communication scheme may involve applying a carrier wave and modulating the carrier wave using digital signals corresponding to the network data.

In one embodiment, the conductive pathway 118 through which the data signals are communicated may include a plurality of channels. For example, the conductive pathway 118 may include two or more conductive rails of the track 120, with each rail including at least one channel of the conductive pathway 118. In another example, the conductive pathway 118 may include several catenaries 718 (shown in FIG. 7) that each represent a separate channel. The slave network interface assembly 300 may alternate between which of the channels is used to transmit the data signals based on one or more transmission characteristics of the channels. A transmission characteristic of a channel represents the ability of the channel to communicate a data signal between a transmitter (such as the equipment management device 112) and a receiver (such as one or more of the wayside equipment assemblies 106, 108, 110). By way of example only, a transmission characteristic of a channel of the conductive pathway 118 may include an availability of the channel to communicate a data signal. A channel may be unable to communicate a data signal when the channel is being used to communicate other data signals or the channel is incapacitated or otherwise incapable of electronically transmitting a data signal.

In another example, a transmission characteristic of a channel may include a Quality of Service (QoS) parameter of the channel. A QoS parameter may be a measurement of the ability of a channel to transmit data signals at a predetermined transmission rate, data flow, throughput, or bandwidth. For example, the QoS parameter may be a comparison of the actual transmission rate of a channel with a predetermined threshold transmission rate of the channel. Alternatively, the QoS parameter may be a measurement of dropped packets of data signals that are transmitted through the channel, a delay or latency of the data signals, jitter or delays among the data packets in a data signal, an order of delivery of the various data packets in the data signal, and/or an error in transmitting one or more of the data packets. The slave network interface assembly 300 may monitor QoS parameters of two or more channels and alternate which of the channels is used to transmit data signals based on the QoS parameters.

In one embodiment, the slave network interface assembly 300 varies which of several channels are used to transmit data signals based on the type of information included in the data signals. For example, one channel may be dedicated to data signals that instruct the wayside equipment assemblies 106, 108, 110 to change a position or status while another channel is dedicated to data signals that request that a diagnostic self-examination be performed by the wayside equipment assemblies 106, 108, 110.

Alternatively, the slave network interface assembly 300 may transmit and/or receive the data signals in a non-electronic manner, such as by using analog signals. In one embodiment, the slave network interface assembly 300 transmits and/or receives acoustic waves as the data signals. For example, the signal modulator module 304 may include an acoustic transmitter, such as a speaker, and/or an acoustic receiver, such as an accelerometer, a microphone, or other pick up device. The acoustic transmitter allows the signal modulator module 304 to transmit acoustic waves as the data signals. The acoustic waves may be directed at the conductive pathway 118 or the ground below the conductive pathway 118 such that the acoustic waves propagate through the conductive pathway 118 and/or ground. The signal modulator module 304 may transmit the acoustic waves at frequencies that are greater than the frequencies at which the rail vehicles 102, 104 vibrate the track 120 and/or ground when the rail vehicles 102, 104 travel along the track 120. The acoustic receiver picks up or receives the acoustic waves being transmitted through the conductive pathway 118 and/or ground and converts the analog signal of the acoustic waves into a digital signal that includes the data signal.

Figure 4:
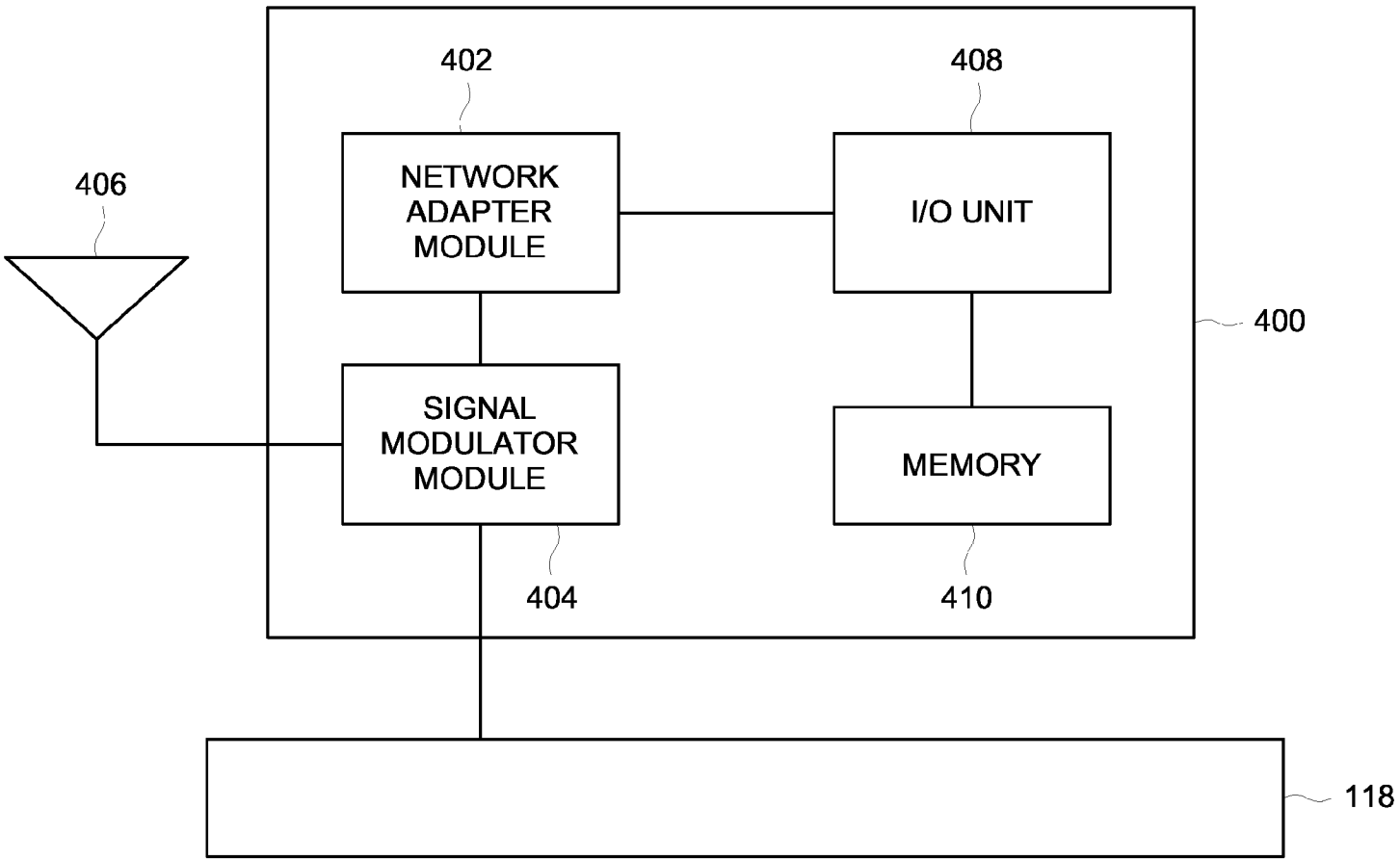
FIG. 4 is a diagram of a master network interface assembly in accordance with one embodiment.

FIG. 4 is a diagram of a master network interface assembly 400 in accordance with one embodiment. The master network interface assembly 400 may be disposed within or coupled with the equipment management device 112 (shown in FIG. 1) to permit the equipment management device 112 to transmit and/or receive data signals through the conductive pathway 118.

Similar to the slave network interface assembly 300 shown in FIG. 3, the master network interface assembly 400 includes a network adapter module 402 and a signal modulator module 404. The modules 402, 404 may be similar to and perform similar functions as the modules 302, 304 (shown in FIG. 3). For example, the signal modulator module 404 may be electrically coupled with the network adapter module 402 and the conductive pathway 118 to modulate and de-modulate data signals communicated through the conductive pathway 118. In one embodiment, the signal modulator module 404 is coupled with a wireless antenna 406 so that the signal modulator module 404 may modulate and de-modulate data signals wirelessly transmitted or received through the antenna 406.

The network adapter module 402 may be electrically connected to an operator interface that permits a human user to provide input to and/or receive output from the network interface assembly 400. In the illustrated embodiment, the operator interface includes an input/output unit 408 ("I/O unit"). The I/O unit 408 is functionally coupled with one or more software or hardware applications stored on a tangible and non-transitory computer readable storage medium, such as a memory 410. The I/O unit 408 can receive input from an operator, such as a rail yard master, to transmit instructions, requests, directions, commands, and the like, through the conductive pathway 118 as the data signals. For example, an operator may input directions or requests for one or more of the wayside equipment assemblies 106, 108, 110 (shown in FIG. 1) into the I/O unit 408.

The I/O unit 408 may visually present output to the operator based on data signals that are received by the master network interface assembly 400. For example, the I/O unit 408 may include a monitor, printer, or other display that visually presents a status, state, or health of one or more of the wayside equipment assemblies 106, 108, 110 (shown in FIG. 1). The I/O unit 408 may present output that is based on received data signals and that can be visually perceived by the operator. In one embodiment, the network adapter module 402, the signal modulator module 404, and/or the I/O unit 408 include standard Ethernet-ready (or other network) components, such as Ethernet adapters.

As described above, the conductive pathway 118 through which the data signals are communicated may include a plurality of channels. Similar to the slave network interface assembly 300 (shown in FIG. 3), the master network interface assembly 400 may alternate between which of the channels is used to transmit the data signals based on one or more transmission characteristics of the channels and/or the type of information included in the data signals.

Alternatively, the master network interface assembly 400 may transmit and/or receive the data signals in a non-electronic manner, such as by using analog signals. In one embodiment, the master network interface assembly 400 transmits and/or receives acoustic waves as the data signals. For example, the signal modulator module 404 may include an acoustic transmitter and/or receiver that transmit and/or receive acoustic waves as the data signals.

Returning to the discussion of the rail equipment communication system 200 shown in FIG. 2, the data signals may be communicated through the conductive pathways 118 as data packets. "Data packets" refers to data that is packaged in packet form, meaning a data packet that comprises a set of associated data bits. (As noted above, data packets are sometimes referred to herein as "network data".) The data packets may include a data fields and a network address or other unique address associated with a device or component that is to receive the data packet. For example, each of the appliance communication devices 122 and the equipment management device 112 may be associated with a unique address that is used to direct data packets to different appliance communication devices 122 or the equipment management device 112. In another embodiment, the data signals may not be communicated in data packets and/or may not include recipient network addresses.

The unique addresses may permit the equipment management device 112 to individually communicate different data signals with different appliance communication devices 122 over the conductive pathways 118. As shown in FIG. 2, different appliance communication devices 122 are coupled with different conductive pathways 118 of different tracks 120. The conductive pathways 118 throughout the rail yard may be electrically coupled with each other to form a network through which the data signals are communicated. The network formed by the conductive pathways 118 may be similar to a computer network that includes hubs, routers, and repeaters, such as a Local Area Network (LAN) or Wide Area Network (WAN). The equipment management device 112 may broadcast data signals to all appliance communication devices 122 electrically coupled to the network formed by the conductive pathways 118. Alternatively, the equipment management device 112 may send individual data signals to fewer than all of the appliance communication devices 122 by including the unique addresses of the different appliance communication devices 122 in the different data signals.

In the illustrated embodiment, the rail equipment communication system 200 includes a remote equipment management device 202. The remote equipment management device 202 may be similar to the equipment management device 112 in that the remote equipment management device 202 communicates data signals with the wayside equipment assemblies 106, 108, 110 via the conductive pathways 118. One difference between the remote equipment management device 202 and the equipment management device 112 is that the remote equipment management device 202 may be decoupled from the conductive pathway 118. For example, the remote equipment management device 202 can be a mobile device that can be moved relative to the tracks 120. In one embodiment, the remote equipment management device 202 is a handheld device that can be carried by an operator, such as a yard master, as the yard master moves around the yard.

The remote equipment management device 202 may include an antenna 204 that wirelessly communicates data signals with the equipment management device 112. For example, the remote equipment management device 202 may wirelessly transmit a data signal from the antenna 204 to the antenna 404 of the equipment management device 112. The equipment management device 112 may then transmit the data signal to one or more of the wayside equipment assemblies 106, 108, 110 through the conductive pathways 118. The equipment management device 112 similarly may wirelessly transmit a data signal received from one or more of the wayside equipment assemblies 106, 108, 110 from the antenna 404 to the antenna 204 of the remote equipment management device 202.

Figure 5:
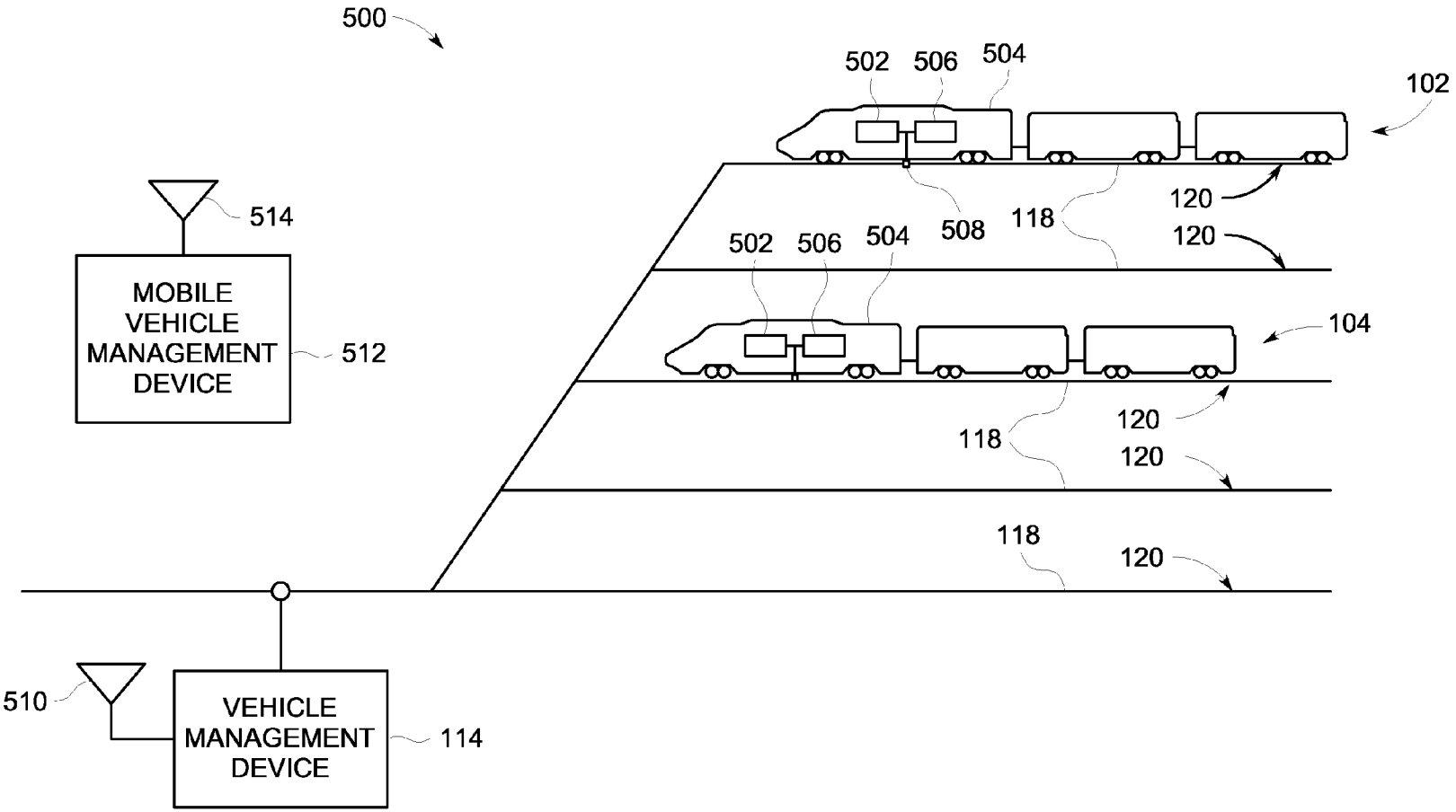
FIG. 5 is a diagram of a vehicle control communication system in accordance with one embodiment.

FIG. 5 is a diagram of a rail vehicle control communication system 500 in accordance with one embodiment. The vehicle control communication system 500 may be part of the rail communication system 100 (shown in FIG. 1). For example, the rail communication system 100 may include a system and associated components that provides for the communication of data signals between and among the management devices 112, 114, 116 (shown in FIG. 1), the rail vehicles 102, 104, and the wayside equipment assemblies 106, 108, 110 (all shown in FIG. 1). Similar to the rail appliance communication system 200 (shown in FIG. 2), the vehicle control communication system 500 may be a subset or subsystem of the rail communication system 100 in that the vehicle control communication system 500 provides for the communication of data signals between and among the vehicle management device 114 and the rail vehicles 102, 104.

The vehicle management device 114 communicates data signals with the rail vehicles 102, 104 to remotely control movement of the rail vehicles 102, 104 in one embodiment. For example, the vehicle management device 114 may be spaced apart from the rail vehicles 102, 104 by several meters or several hundred meters in a rail yard or other area yet is able to change the speed of the rail vehicles 102, 104 and/or stop movement of the rail vehicles 102, 104. The vehicle management device 114 controls the movement of the rail vehicles 102, 104 by communicating data signals through the conductive pathways 118 that extend along the tracks 120. In one embodiment, the vehicle management device 114 remotely controls the speed and/or other movement of the rail vehicles 102, 104 while one or more of the rail vehicles 102, 104 are moving.

In one embodiment, the vehicle management device 114 transmits data signals to the rail vehicles 102, 104 through the conductive pathways 118 to remotely operate the rail vehicles 102, 104 where at least one of the rail vehicles 102, 104 is unmanned. For example, the vehicle management device 144 may control movement of rail vehicles 102, 104 that do not have one or more on-board human operators to control movement of the rail vehicles 102, 104. An off-board human operator may control the vehicle management device 114 (which is located off-board of the rail vehicle 102 or 104) to generate instructions to control operation of the rail vehicle 102 or 104. The vehicle management device 114 than transmits the instructions to the unmanned rail vehicle 102 or 104 through the conductive pathways 118.

The vehicle management device 114 is a logic based device in one embodiment. For example, the vehicle management device 114 may include a processor, such as a computer microprocessor. As another example, the vehicle management device 114 may be or include a hardwired control unit located in a control tower, dispatch center, or the like, of a rail yard. In another embodiment, the vehicle management device 114 includes or is a wayside RCL control unit that is affixed to the conductive pathways 118, such as by being permanently attached to the conductive pathways 118.

The vehicle management device 114 may change the tractive effort and/or braking effort of the rail vehicles 102, 104. For example, the vehicle management device 114 may transmit an instruction to one or more of the rail vehicles 102, 104 that directs the rail vehicles 102, 104 to speed up or slow down. Alternatively, the vehicle management device 114 may transmit an instruction that directs the rail vehicles 102, 104 to slow down or stop. The vehicle management device 114 can transmit different instructions to different rail vehicles 102, 104 in one embodiment. For example, the vehicle management device 114 may transmit a first data signal that instructs the rail vehicle 102 to speed up and a second data signal that instructs the rail vehicle 104 to slow down or stop. Both the first and second data signals may be transmitted through the conductive pathways 118.

The rail vehicles 102, 104 include propulsion subsystems 502 that control movement of the rail vehicles 102, 104. For example, the rail vehicles 102, 104 may include powered units 504, such as locomotives, that have propulsion subsystems 502 for generating tractive effort that propels the rail vehicles 102, 104 along the tracks 120 and/or for imparting braking effort that slows or stops the rail vehicles 102, 104. The propulsion subsystems 502 can include engines coupled with alternators or generators to create electric current that is supplied to one or more traction motors. The traction motors rotate wheels of the rail vehicles 102, 104 to propel the rail vehicles 102, 104. The propulsion subsystems 502 may include brakes, such as dynamic and/or air brakes to slow or stop movement of the rail vehicles 102, 104. Alternatively, the propulsion subsystems 502 include circuits that receive electric current from an external source, such as the catenary 718 (shown in FIG. 7) or a powered rail, and supply the current to the traction motors to propel the rail vehicles 102, 104.

In order to receive data signals communicated through the conductive pathways 118, the rail vehicles 102, 104 include on-board communication devices 506. The on-board communication devices 506 are communicatively coupled with the propulsion subsystems 502, such as by one or more wired or wireless connections. The on-board communication devices 506 are, in turn, coupled with the conductive pathways 118 by connectors 508. The on-board communication devices 506 transmit and/or receive data signals through the conductive pathways 118. The on-board communication devices 506 may include transceivers, modems, routers, and the like, to electrically transmit data signals to and/or receive data signals from the vehicle management device 114. The on-board communication devices 506 can communicate the data signals as discrete data packets that include blocks of data that are individually communicated with the vehicle management device 114.

The connectors 508 are components that electrically couple the on-board communication devices 506 with the conductive pathways 118. The connectors 508 electrically couple the on-board communication devices 506 with the conductive pathways 118 when the rail vehicles 102, 104 are stationary and/or moving relative to the conductive pathways 118 in one embodiment. The connectors 508 may include conductive members that slide or move along the conductive pathways 118 to transmit and/or receive the data signals. By way of example only, the connectors 508 may include one or more conductive brushes, sliding skirts, pick-up coils, or wheels of the rail vehicles 102, 104 that engage and provide electric coupling with the conductive pathways 118. While only one connector 508 per rail vehicle 102, 104 is shown in FIG. 5, alternatively the rail vehicles 102, 104 may include multiple connectors 508. For example, multiple cars, locomotives, or other units of each rail vehicle 102, 104 may include connectors 508.

In one embodiment, the on-board communication devices 506 of the rail vehicles 102, 104 include or are communicatively coupled with a network interface assembly, such as the slave network interface assembly 300 (shown in FIG. 3) in order to transmit and/or receive data signals through the conductive pathways 118. The on-board communication devices 506 also may include or be communicatively coupled with device interface unit, such as the device interface unit 308 (shown in FIG. 3). The slave network interface assembly 300 receives data signals transmitted by the vehicle management device 114 through the conductive pathways 118. The slave network interface assembly 300 may demodulate and/or process the data signals and communicate the data signals to the device interface unit 308.

The device interface unit 308 (shown in FIG. 3) can be coupled with the propulsion subsystems 502 by the external interfaces 314 (shown in FIG. 3). In one embodiment, the device interface unit 308 includes or operates based on software applications that cause the device interface unit 308 to control the propulsion subsystems 502 based on the instructions received in data signals received by the slave network interface assemblies 300 (shown in FIG. 3). For example, if a data signal includes an instruction to slow down the rail vehicle 102, the slave network interface assembly 300 receives the data signal from the conductive pathway 118 and conveys the data signal to the device interface unit 308. The device interface unit 308 directs the propulsion subsystem 502 to decrease a throttle of the engine of the rail vehicle 102 and/or apply a brake of the rail vehicle 102.

Similar to the equipment management device 112 (shown in FIG. 1), the vehicle management device 114 may include the master network interface assembly 400 (shown in FIG. 4) in order to transmit and/or receive data signals to the rail vehicles 102, 104 through the conductive pathways 118. In one embodiment, the master network interface assembly 400 of the vehicle management device 114 is communicatively coupled with a wireless antenna 510 of the vehicle management device 114 so that the vehicle management device 114 may transmit and/or receive wireless data signals through the antenna 510.

The master network interface assembly 400 may transmit different data signals to the rail vehicles 102, 104 based on the type of information that is included in the data signals. For example, in a situation where the master network interface assembly 400 is instructed to send multiple conflicting or inconsistent data signals to a rail vehicle 102 or 104, the master network interface assembly 400 may determine which of the data signals is transmitted to the rail vehicle 102 or 104 based on the information or instruction included in the data signal. By way of non-limiting example only, if the master network interface assembly 400 is directed by one or more operators to instruct a rail vehicle 102 or 104 to speed up and slow down at the same time, the master network interface assembly 400 may consult a list or database of priority rules that dictate which of the instructions is to be sent to the rail vehicle 102 or 104. In one embodiment, such a list or database can give higher priority to instructions that provide for less risk of an accident. As a result, the master network interface assembly 400 may instruct the rail vehicle 102 or 104 to slow down or brake when conflicting instructions of speeding up and slowing down are requested by an operator.

In another embodiment, the master network interface assembly 400 may resolve which of multiple conflicting or inconsistent instructions are to be transmitted to a rail vehicle 102, 104 based on a location of the rail vehicle 102, 104. For example, if the rail vehicle 102, 104 is traveling along one segment 806, 812, 906, 912 (shown in FIGS. 8 and 9) of the track 120, then one type of instruction (such as instructions that decrease or reduce the speed of the rail vehicle 102, 104) may have higher priority than other types of instructions (such as instructions that do not decrease or reduce the speed of the rail vehicle 102, 104). The instruction or instructions having the highest priority may be transmitted before instructions with lower priority by the master network interface assembly 400. Alternatively, the instructions having higher priority may be transmitted instead of the instructions having lower priority.

The vehicle management device 114 includes an operator interface, such as the I/O unit 408 (shown in FIG. 4), in order to permit an operator to remotely control movements of the rail vehicles 102, 104. The I/O unit 408 may include one or more input devices, such as a touchscreen, electronic mouse, keyboard, joystick, and the like, and one or more output devices, such as the touchscreen, monitor, or other visual display. An operator may use the I/O unit 408 to change the speed and/or movement of one or more of the rail vehicles 102, 104. In one embodiment, the I/O unit 408 presents the operator with a map of the rail system or rail yard that includes the conductive pathways 118 and displays the positions of the rail vehicles 102, 104 and/or wayside equipment assemblies 106, 108, 110 (shown in FIG. 1) relative to the conductive pathways 118. The operator may use the I/O unit 408 to change the speed or movement of one or more rail vehicles 102, 104. Based on the operator's input, the I/O unit 408 forms an instruction to the rail vehicles 102, 104 and conveys the instruction to the network adapter module 402 (shown in FIG. 4) of the master network interface assembly 400 (shown in FIG. 4) of the vehicle management device 114.

The network adapter module 402 (shown in FIG. 4) formulates a data signal representative of the instructions and transmits the data signal to the signal modulator module 404 (shown in FIG. 4). The signal modulator module 404 communicates the data signal to the rail vehicles 102, 104 through the conductive pathways 118.

In one embodiment, the rail vehicles 102, 104 transmit data signals to the vehicle management device 114 through the conductive pathways 118 using the device interface unit 308 (shown in FIG. 3) and the slave network interface assembly 300 (shown in FIG. 3). The rail vehicles 102, 104 may communicate statuses of the rail vehicles 102, 104. By way of example only, a status of a rail vehicle 102, 104 may include a location, speed, throttle setting, brake setting, operating temperature, fuel level, a notice of a need for maintenance, or a notice of an inattentive operator of the rail vehicle 102, 104. The notice of a need for maintenance may be determined by one or more sensors on the rail vehicle 102, 104 that a parameter of the rail vehicle 102, 104 is outside of a predetermined range or threshold and the rail vehicle 102, 104 requires repair. The notice of an inattentive operator may be generated by the device interface unit 308 when the operator of the rail vehicle 102, 104 fails to actuate a switch or button that must be actuated within a periodically repeating countdown timer to avoid stopping movement of the rail vehicle 102, 104. The I/O unit 408 (shown in FIG. 4) of the vehicle management device 114 may visually present the statuses of the rail vehicles 102, 104 for review by the operator of the vehicle management device 114.

Similar to the rail appliance communication system 200 shown in FIG. 2, the data signals may be communicated through the conductive pathways 118 in the rail vehicle communication system 500 as data packets. The data packets may include a data fields and a network address or other unique address associated with one or more of the rail vehicles 102, 104. For example, each rail vehicle 102, 104 may be associated with a unique address that is used to direct data packets to specific ones of the rail vehicles 102, 104. In another embodiment, the data signals may not be communicated in data packets and/or may not include recipient network addresses. The unique addresses permit the vehicle management device 114 to individually communicate different data signals to different rail vehicles 102, 104 through the same conductive pathways 118. For example, the vehicle management device 114 may independently control the propulsion subsystems 506 of different rail vehicles 102, 104 by communicating different data signals to different rail vehicles 102, 104 based on the addresses of the rail vehicles 102, 104. Alternatively, the vehicle management device 114 may broadcast the same data signals to all rail vehicles 102, 104 to commonly control the propulsion subsystems 506 of the rail vehicles 102, 104. Alternatively, the vehicle management device 114 may send individual data signals to fewer than all of the rail vehicles 102, 104 by including the unique addresses of one or more of the rail vehicles 102, 104 in the data signals.

In the illustrated embodiment, the rail vehicle communication system 500 includes a mobile vehicle management device 512, or mobile management device 512. Similar to the remote equipment management device 202 (shown in FIG. 2), the mobile vehicle management device 512 communicates data signals with the rail vehicles 102, 104 through the conductive pathways 118. As shown in FIG. 5, the mobile vehicle management device 512 may be decoupled from the conductive pathways 118. For example, the mobile vehicle management device 512 can be a handheld device that can be carried by an operator, such as a yard master, as the yard master walks around the rail yard.

The mobile vehicle management device 512 may include an antenna 514 that wirelessly communicates data signals with the vehicle management device 114. For example, the mobile vehicle management device 512 may wirelessly transmit a data signal from the antenna 514 to the antenna 510 of the vehicle management device 114. The vehicle management device 114 may then transmit the data signal to one or more of the rail vehicles 102, 104 through the conductive pathways 118. The vehicle management device 114 similarly may wirelessly transmit a data signal received from one or more of the rail vehicles 102, 104 via the antennas 510, 514.

In one embodiment, the mobile vehicle management device 512 is or includes a portable wireless remote control locomotive (RCL) control unit, such as a battery powered device that is able to be carried by a human operator. Such a RCL control unit may communicate wireless control signals to the vehicle management device 114, which serves as a trackside interface device attached to the conductive pathways 118. The vehicle management device 114 generates the data signals for transmitting instructions input or generated by the mobile vehicle management device 512 over the conductive pathways 118 based on the wireless signals received from the portable mobile vehicle management device 512. As one example, the mobile vehicle management device 512 may communicate with the vehicle management device 114 by way of local wireless signals that are broadcast over a relatively limited area, such as a range of 100 meters or less, 10 meters or less, or 1 meter or less. For example, the mobile vehicle management device 512 may communicate with the vehicle management device 114 using BlueTooth™ signals. Alternatively, the mobile vehicle management device 512 may physically interface with the vehicle management device 114, such as by one or more connectors and/or cables that mate with each other.

Figure 6:
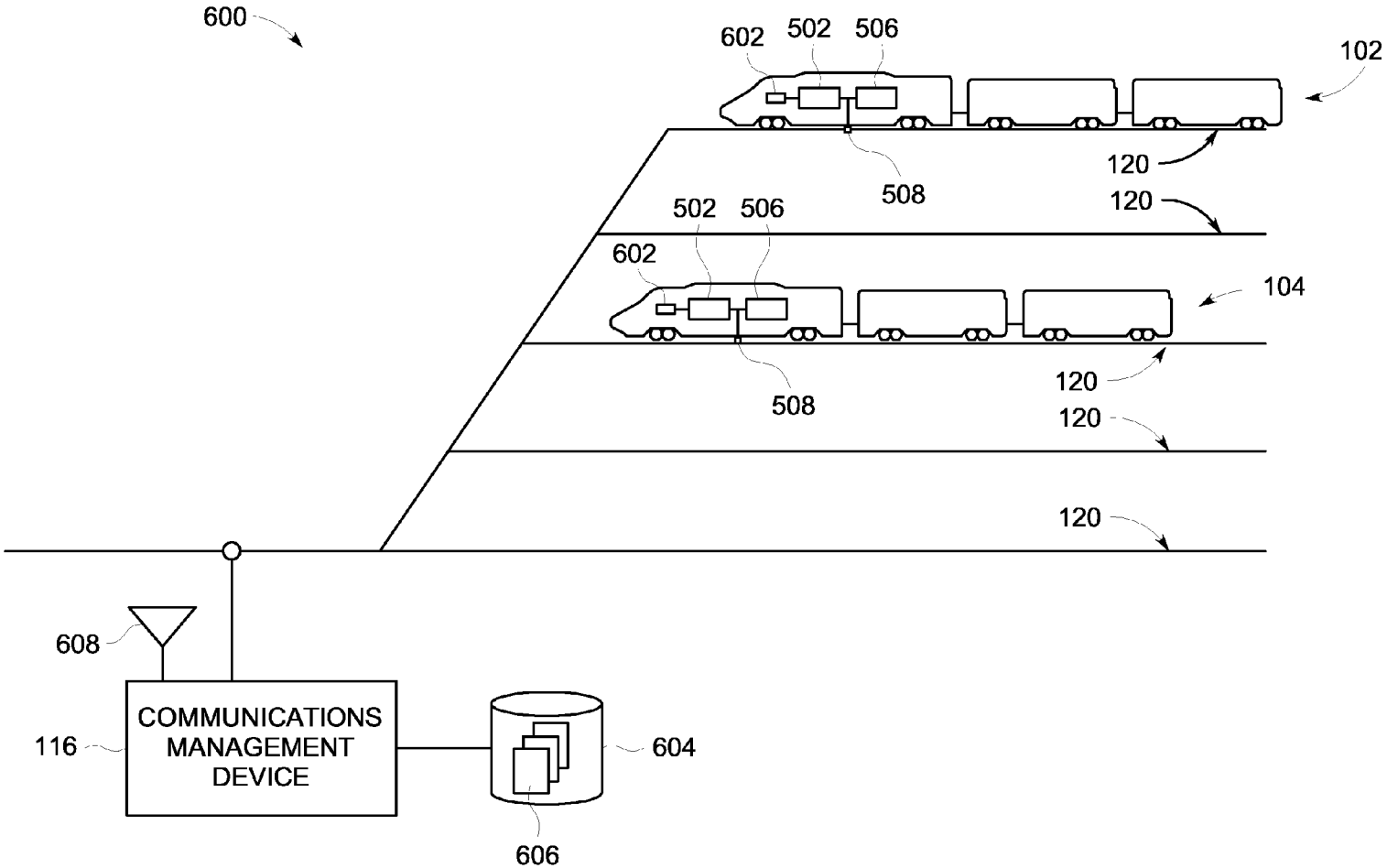
FIG. 6 is a diagram of a trip data communication system in accordance with one embodiment.

FIG. 6 is a diagram of a trip data communication system 600 in accordance with one embodiment. The trip data communication system 600 may be part of the rail communication system 100 (shown in FIG. 1). For example, similar to the rail appliance communication system 200 (shown in FIG. 2) and the vehicle equipment system 500 (shown in FIG. 5), the trip data communication system 600 may be a subset or subsystem of the rail communication system 100 in that the trip data communication system 600 provides for the communication of data signals between and among the communications management device 116 and the rail vehicles 102, 104.

The communications management device 116 communicates data signals with the rail vehicles 102, 104 to remotely upload and/or download information related to an upcoming trip and/or a previous trip of the rail vehicles 102, 104. For example, the communications management device 116 may be spaced apart from the rail vehicles 102, 104 by several meters or several hundred meters in a rail yard or other area. The communications management device 116 may transmit data signals to the rail vehicles 102, 104 through the conductive pathways 118 that include information related to a trip that the rail vehicles 102, 104 are scheduled to take. This information may be referred to as "upcoming trip-related information." The upcoming trip-related information includes one or more details about the route that the rail vehicle 102 or 104 will be taking, such as a beginning point and/or destination of the trip, a grade of one or more sections of the track 120 during the trip, a radius of one or more turns in the track 120 during the trip, one or more speed limits of the rail vehicle 102 or 104 during the trip, locations of signals, rail vehicle monitoring apparatuses, or other wayside equipment assemblies 106, 108, 110 (shown in FIG. 1) along the trip, pollutant emission limitations or thresholds that apply to the rail vehicle 102 or 104 during the trip, and the like. The upcoming trip-related information varies for different rail vehicles 102, 104 and/or for different trips.

As described above, the rail vehicles 102, 104 include propulsion subsystems 502 that apply tractive effort to move the rail vehicles 102, 104 along the tracks 120. The rail vehicles 102, 104 may include one or more computer units 602, such as a processor-based computing device, that uses the upcoming trip-related information to manage the propulsion subsystems 502 during the upcoming trip. The computer units 602 of one or more of the rail vehicles 102, 104 may operate based on a software application that uses the upcoming trip-related information to automatically adjust the throttle and/or brake settings of the propulsion subsystems 502 during the trip. For example, the computer units 602 in one or more of the rail vehicles 102, 104 may be equipped with the Trip Optimizer™ software application from General Electric Company.

In one embodiment, the rail vehicles 102, 104 transmit data signals to the communications management device 116 through the conductive pathways 118. These data signals may include information related to a previous trip that the rail vehicles 102, 104 have completed, or have completed at least a portion thereof. This information may be referred to as "previous trip-related information" and/or a log of operational information related to an operator's control of the rail vehicle during a previous trip of the rail vehicle 102 or 104. The previous trip-related information includes one or more details about the route that the rail vehicle 102 or 104 took during the previous trip. By way of example only, the previous trip-related information may include the speeds at which the rail vehicle 102, 104 moved during the trip, the throttle and/or brake settings of the propulsion subsystems 502 during the trip, amounts of fuel consumed during the trip, stops made during the trip, signals that were missed by the operator of the rail vehicle 102, 104, or speed limits that were disobeyed by the operator of the rail vehicle 102, 104.

The previous trip-related information may be transmitted to the communications management device 116 and stored on a tangible and non-transitory computer readable storage medium, such as a memory 604 having one or more databases 606. The memory 604 may store the previous trip-related information in the databases 606 for analysis of the rail vehicles 102, 104 and/or operators. For example, the previous trip-related information may be analyzed for a rail vehicle 102 in order to determine trends in the operation of the rail vehicle 102. The trends may be used to identify a need for repair or tuning up of the rail vehicle 102, or an increased risk of failure of the rail vehicle 102 during operation. In another example, the previous trip-related information may be analyzed for an operator for quality control purposes. The previous trip-related information may reveal which operators frequently disobey signals or speed limits so that those operators may be retrained and their actions corrected.

As described above, the on-board communication devices 506 and connectors 508 of the rail vehicles 102, 104 may be used to upload and/or download information included in data signals that are received by and/or transmitted from the rail vehicles 102, 104 through the conductive pathways 118. In one embodiment, the on-board communication devices 506 of the rail vehicles 102, 104 are communicatively coupled with the computer units 602. The computer units 602 may store the upcoming and/or previous trip-related information. For example, the computer units 602 may include a tangible and non-transitory computer readable storage medium, similar to the memory 604, where the trip-related information is stored.

Similar to the equipment management device 112 (shown in FIG. 1) and the vehicle management device 114 (shown in FIG. 1), the communications management device 116 may include the master network interface assembly 400 (shown in FIG. 4) in order to transmit and/or receive data signals to the rail vehicles 102, 104 through the conductive pathways 118. In one embodiment, the master network interface assembly 400 of the communications management device 116 is communicatively coupled with a wireless antenna 608 of the communications management device 116 so that the communications management device 116 may transmit and/or receive wireless data signals through the antenna 608.

The communications management device 116 may include an operator interface, such as the I/O unit 408 (shown in FIG. 4), in order to permit an operator to remotely view the status of uploading and/or downloading trip-related information to and/or from the rail vehicles 102, 104. For example, the amount of data that includes the trip-related information may be significant and require a relatively large amount of time to upload to the rail vehicles 102, 104 or download from the rail vehicles 102, 104 through the conductive pathways 118. The I/O unit 408 can display the status of the uploading or downloading so that an operator of the communications management device 116 may see how much longer the uploading or downloading will take. In one embodiment, the I/O unit 408 includes a display that permits the operator to see the trip-related information that is being uploaded to or downloaded from the rail vehicles 102, 104.

Similar to the rail appliance communication system 200 (shown in FIG. 2) and the rail vehicle communication system 500 (shown in FIG. 5), the data signals may be communicated through the conductive pathways 118 in the trip data communication system 600 as data packets. The data packets may include a data fields and a network address or other unique address associated with one or more of the rail vehicles 102, 104. The unique addresses permit the communications management device 116 to individually communicate different data signals to different rail vehicles 102, 104 through the same conductive pathways 118.

The trip-related information that is communicated between the communication management device 116 and the rail vehicles 102, 104 may be transmitted through different channels of the conductive pathway 118. As described above, the channel(s) through which the trip-related information is transmitted may be selected based on one or more of transmission characteristics of the channels and/or a type of information. For example, one channel may be dedicated to transmitting upcoming trip-related information to the rail vehicles 102, 104 while another channel is dedicated to transmitting previous trip-related information to the communication management device 116.

Figure 7:
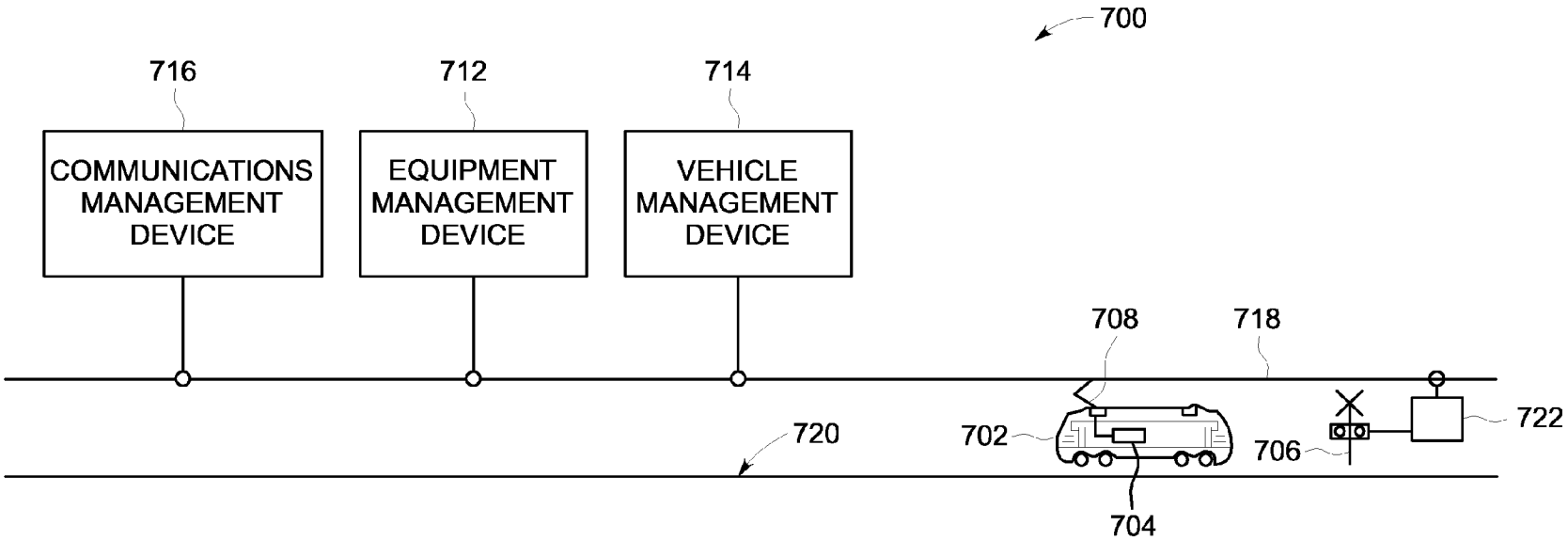
FIG. 7 is a diagram of a rail communication system in accordance with another embodiment.

FIG. 7 is a diagram of a rail communication system 700 in accordance with another embodiment. The rail communication system 700 permits the communication of data signals with an electric rail vehicle 702 disposed on or traveling along a track 720 and/or a wayside equipment assembly 706 disposed alongside or on the track 720. The rail communication system 700 shown in FIG. 7 includes an equipment management device 712, a vehicle management device 714, and a communications management device 716. The equipment management device 712 may be similar to the equipment management device 112 (shown in FIG. 1) in that the equipment management device 712 communicates data signals with the wayside equipment assembly 706. The vehicle management device 714 may be similar to the vehicle management device 114 (shown in FIG. 1) and/or the communications management device 716 may be similar to the communications management device 116 (shown in FIG. 1) in that the vehicle management device 714 and the communications management device 716 communicate data signals with the rail vehicle 702.

One difference between the rail communication system 700 and the rail communication system 100 shown in FIG. 1 is that the rail communication system 700 communicates data signals between the management devices 712, 714, 716 and the rail vehicle 702, and/or between the management devices 712, 714, 716 and the wayside equipment assembly 706, through a conductive pathway that includes the catenary 718 extending along the track 720. For example, instead of or in addition to communicating the data signals through the rails of the track 720, the rail communication system 700 may transmit and receive the data signals (e.g., network data) through the catenary 718 that also supplies electric current to the rail vehicle 702 to power the rail vehicle 702. Similar to the management devices 112, 114, 116 (shown in FIG. 1), the management devices 712, 714, 716 may use one or more of a variety of communication protocols to transmit and receive the data signals, such as TCP/IP, UDP, or ICMP.

The data signals communicated through the catenary 718 may be transmitted using differential signals. For example, the data signals may be transmitted by applying a differential signal to the catenary 718. The differential signal may be applied as a differential signal across or between the catenary 718 and a conductive rail of the track 720 or across or between the catenary 718 and a ground reference. Alternatively, the data signal may be communicated as a single-ended signal.

Similar to the rail vehicles 102, 104 (shown in FIG. 1), the rail vehicle 702 includes an on-board communication device 704. The on-board communication device 704 may be similar to the on-board communication device 506 (shown in FIG. 5). The on-board communication device 704 can be communicatively coupled with propulsion subsystems of the rail vehicle 702, such as one or more traction motors and the circuits that deliver the electric current from the catenary 718 to the traction motors. The on-board communication device 704 also is connected with the catenary 718 by a conductive extension 708 that extends from the rail vehicle 702 to electrically couple the propulsion subsystem of the rail vehicle 702 with the catenary 718.

The on-board communication device 704 transmits and/or receives data signals through the conductive extension 708 and the catenary 718. The on-board communication device 704 may include transceivers, modems, or routers to electrically transmit data signals to and/or receive data signals from the management devices 712, 714, 716. In one embodiment, the on-board communication device 704 includes or is communicatively coupled with a network interface assembly, such as the slave network interface assembly 300 (shown in FIG. 3) in order to transmit and/or receive data signals through the catenary 718, similar to as described above in connection with the on-board communication devices 506 (shown in FIG. 5).

Similar to the management devices 112, 114, 116 (shown in FIG. 1), the management devices 712, 714, 716 may include the master network interface assembly 400 (shown in FIG. 4) in order to transmit and/or receive data signals to the rail vehicle 702 and/or the wayside equipment assembly 706 through the catenary 718. The master network interface assembly 400 may be disposed within or coupled with one or more of the management devices 712, 714, 716 to transmit and/or receive data signals through the catenary 718. The wayside equipment assembly 706 is communicatively coupled with an appliance communication device 722, which is coupled with the catenary 718. Similar to the appliance communication devices 122, (shown in FIG. 1), the appliance communication device 722 communicates the data signals through the catenary 718 with the management device 712, 714, and/or 716.

Figure 8:
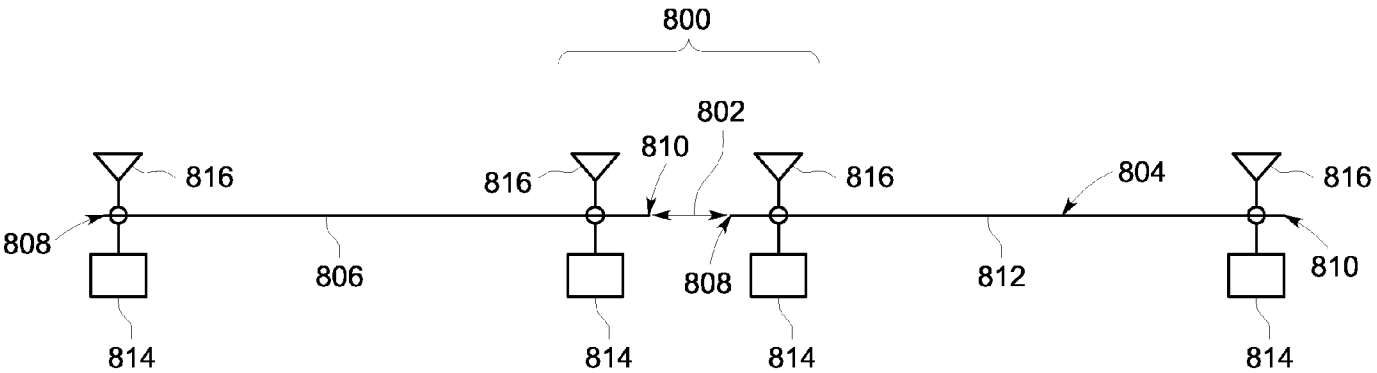
FIG. 8 illustrates a diagram of a communication bridge assembly in accordance with one embodiment.

FIG. 8 illustrates a diagram of a communication bridge assembly 800 in accordance with one embodiment. The bridge assembly 800 communicates data signals across a gap 802 in a conductive pathway 804. The bridge assembly 800 may be used with one or more of the communication systems 100, 200, 500, 600, and/or 700 (shown in FIGS. 1, 2, 5, 6, and 7) in order to allow the data signals to be transmitted across gaps 802 in the conductive pathways 118, 718 (shown in FIGS. 1 and 7). For example, the rails of the track 120 (shown in FIG. 1) and/or the catenary 718 may be divided into segments 806, 812. The segments 806, 812 extend between opposite ends 808, 810. The gap 802 represents the separation or distance between the ends 810, 808 of adjacent or neighboring segments 806, 812. The gap 802 may prevent the data signals from being communicated from one segment 806 to a neighboring segment 812.

The bridge assembly 800 communicates the data signals transmitted through one segment 806 to the neighboring segment 812. In the illustrated embodiment, the bridge assembly 800 wirelessly communicates the data signals across the gap 802 and between the segments 806, 812. The bridge assembly 800 includes transceivers 814 that are communicatively coupled with the segments 806, 812. For example, the transceivers 814 may be conductively wired with the segments 806, 812 at or near one or more of the ends 808, 810 of the segments 806, 812.

The transceivers 814 receive the data signals communicated through the segments 806, 812 and wirelessly transmit the data signals across the gap 802 to another segment 806, 812. For example, the transceiver 814 that is coupled with the segment 806 at or near the end 810 receives the data signals communicated through the segment 806 and wirelessly transmits the data signals across the gap 802 to the transceiver 814 that is coupled with the segment 812 at or near the end 808.

The transceivers 814 include antennas 816 and may include modules that are similar to the modules 302, 304 (shown in FIG. 3) and/or the modules 402, 404 (shown in FIG. 4) to enable the transceivers 814 to receive and demodulate data signals communicated through the conductive pathway 804 and to wirelessly transmit the data signals to another transceiver 814. The transceivers 814 may receive wireless data signals from another transceiver 814 and transmit the data signals along the conductive pathway 804. The transceivers 814 permit the data signals to jump or bridge across the gaps 802 in the conductive pathway 804. In one embodiment, the transceivers 814 perform one or more network functions, such as filtering the data signals and/or wireless signals to increase a signal-to-noise ratio of the signals.

Each of the transceivers 814 may be associated with a network address or other unique address. The transceivers 814 may use the addresses to ensure that the data signals are wirelessly transmitted between the transceivers 814 on opposite sides of the same gap 802. For example, the transmitter 814 disposed at or near the end 810 of the segment 806 may wirelessly transmit data signals only to the address of the transmitter 814 that is at or near the end 808 of the segment 812.

Figure 9:
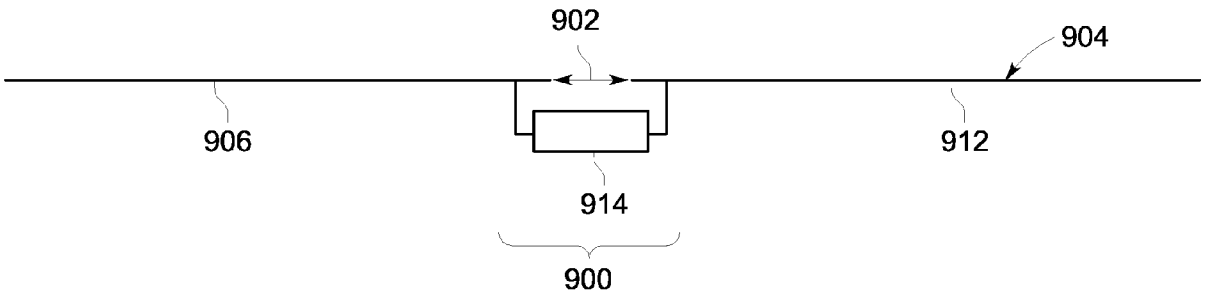
FIG. 9 is a diagram of a communication bridge assembly in accordance with another embodiment.

FIG. 9 is a diagram of a communication bridge assembly 900 in accordance with another embodiment. Similar to the bridge assembly 800 (shown in FIG. 8), the bridge assembly 900 communicates data signals across a gap 902 in a conductive pathway 904 that includes neighboring segments 906, 912. The bridge assembly 900 may be used with one or more of the communication systems 100, 200, 500, 600, and/or 700 (shown in FIGS. 1, 2, 5, 6, and 7) in order to allow the data signals to be transmitted across gaps 902 in the conductive pathways 118, 718 (shown in FIGS. 1 and 7).

In the illustrated embodiment, the bridge assembly 900 includes a cable jumper 914 that is conductively coupled with the segments 906, 912. For example, the cable jumper 914 may have one or more wired connections with the segments 906, 912 such that the cable jumper 914 forms a conductive bridge across the gap 902.

The bridge assembly 900 communicates the data signals transmitted through one segment 906 to the neighboring segment 912. The cable jumper 914 may be provided as a flexible cable that electrically joins the segments 906, 912. In one embodiment, one or more modules that are similar to the modules 302, 304, 402, 404 (shown in FIGS. 3 and 4) may be included in the cable jumper 914. The modules may perform one or more network functions on the data signals, such as filtering the signals. In one embodiment, the cable jumper 914 acts as a bandpass filter, allowing network or other data of a designated frequency range to pass, but preventing signals outside the designated frequency range from passing. This may be useful if low frequency track circuit signals are also being applied to the segments 906, 912 for vehicle detection purposes or otherwise.

Returning to the discussion of the communication systems 500, 600, 700 shown in FIGS. 5, 6, and 7 and with continued discussion of the bridge assemblies 800, 900, one or more of the management devices 114, 116, 714, 716 may communicate with different rail vehicles 102, 104, 702 based on which segment 806, 812, 906, 912 the rail vehicles 102, 1-4, 702 are traveling along. The management devices 114, 116, 714, 716 may be dedicated devices that communicate data signals with rail vehicles 102, 104, 702 through only one or more segments 806, 812, 906, 912 of a conductive pathway 804, 904. For example, the vehicle management device 114 may communicate with the rail vehicles 102, 104 when the rail vehicles 102, 104 travel along and engage one rail segment 806 but not with the rail vehicles 102, 104 traveling along or engaging other rail segments 812.

In one embodiment, the conductive pathways 118, 718 may be divided into multiple communication paths based on the locations of the gaps 802, 902. For example, the conductive pathways 118, 718 may be separated into multiple communication paths with each path permitting transmission of data signals throughout that path and not through another path. The conductive pathways 118, 718 may be divided into the different paths by providing bridge assemblies 800, 900 across the gaps 802, 902 located within the paths but not at the ends of the paths. For example, one path is separated from the other paths by not providing a bridge assembly 800, 900 between the paths to permit communication of the data signals from one path to another. The different paths may be treated as separate communication channels. The separate communication channels allow for the parallel or concurrent transmission of multiple data signals to different rail vehicles 102, 104, 702 and/or wayside equipment assemblies 106, 108, 110, 706 along the separate channels.

With respect to the vehicle management device 114, 714 shown in FIGS. 5 and 7, the segments 806, 812, 906, 912 of the conductive pathways 118, 718, 804, 904 can be used to provide additional safety features in the remote control of the rail vehicles 102, 104. For example, the vehicle management devices 114, 714 may transmit instructions to the rail vehicles 102, 104, 702 as data signals that are communicated through the conductive pathways 118, 718, 804, 904. The data signals may be associated with or include the unique addresses of one or more of the transceivers 814 or cable jumpers 914 of the bridge assemblies 800, 900 that communicate the data signals across the gaps 802, 902 in the conductive pathways 118, 718, 804, 904. The addresses may be used by the vehicle management devices 114, 714 to control which of the bridge assemblies 800, 900 transmit the data signals across associated gaps 802, 902 between segments 806, 812, 906, 912 while other bridge assemblies 800, 900 do not transmit the data signals across the associated gaps 802, 902. In doing so, the vehicle management devices 114, 714 can control which segments 806, 812, 906, 912 transmit the data signals.

The vehicle management devices 114, 714 control which of the different segments 806, 812, 906, 912 transmit the data signals to ensure that only those rail vehicles 102, 104, 702 traveling on or along those segments 806, 812, 906, 912 are able to receive the data signals. For example, the vehicle management devices 114, 714 may control operations of the rail vehicles 102, 104, 702 travelling along certain segments 806, 812, 906, 912 of the track 120. The vehicle management devices 114, 714 may transmit the data signals only to those segments 806, 812, 906, 912 to prevent controlling rail vehicles 102, 104, 702 traveling along other, different segments 806, 812, 906, 912.

Alternatively, the vehicle management devices 114, 714 may change which segments 806, 812, 906, 912 are used to transmit data signals based on the type of instruction included in the data signals. For example, the vehicle management devices 114, 714 may only transmit instructions to increase a speed of a rail vehicle 102, 104, 702 along certain segments 806, 812, 906, 912 of the track 120 while the vehicle management devices 114, 714 cannot or do not transmit instructions to increase a speed of a rail vehicle 102, 104, 702 along other segments 806, 812, 906, 912.

In another embodiment, the vehicle management devices 114, 714 may transmit instructions as data signals to control operations of rail vehicles 102, 104, 702 that are concurrently traveling along two or more neighboring segments 806, 812, 906, 912 of the conductive pathways 118, 718, 804, 904. For example, the vehicle management devices 114, 714 may only transmit data signals along two or more adjacent or neighboring segments 806, 812, 906, 912 of the track 120. A rail vehicle 102, 104, 702 having multiple connectors 508 (shown in FIG. 5) that are concurrently or simultaneously coupled with the two or more adjacent or neighboring segments 806, 812, 906, 912 receive and act upon the data signals. For example, only those rail vehicles 102, 104, 702 that interconnect the two or more adjacent or neighboring segments 806, 812, 906, 912 at the same time may receive and obey the instructions contained in the data signals transmitted along the two or more adjacent or neighboring segments 806, 812, 906, 912. The rail vehicle management devices 114, 714 may change which data signals are transmitted along the different adjacent or neighboring segments 806, 812, 906, 912 based on the type of instruction included in the data signals and/or the rail vehicle 102, 104, 702 being controlled by the data signal.

Figure 10:
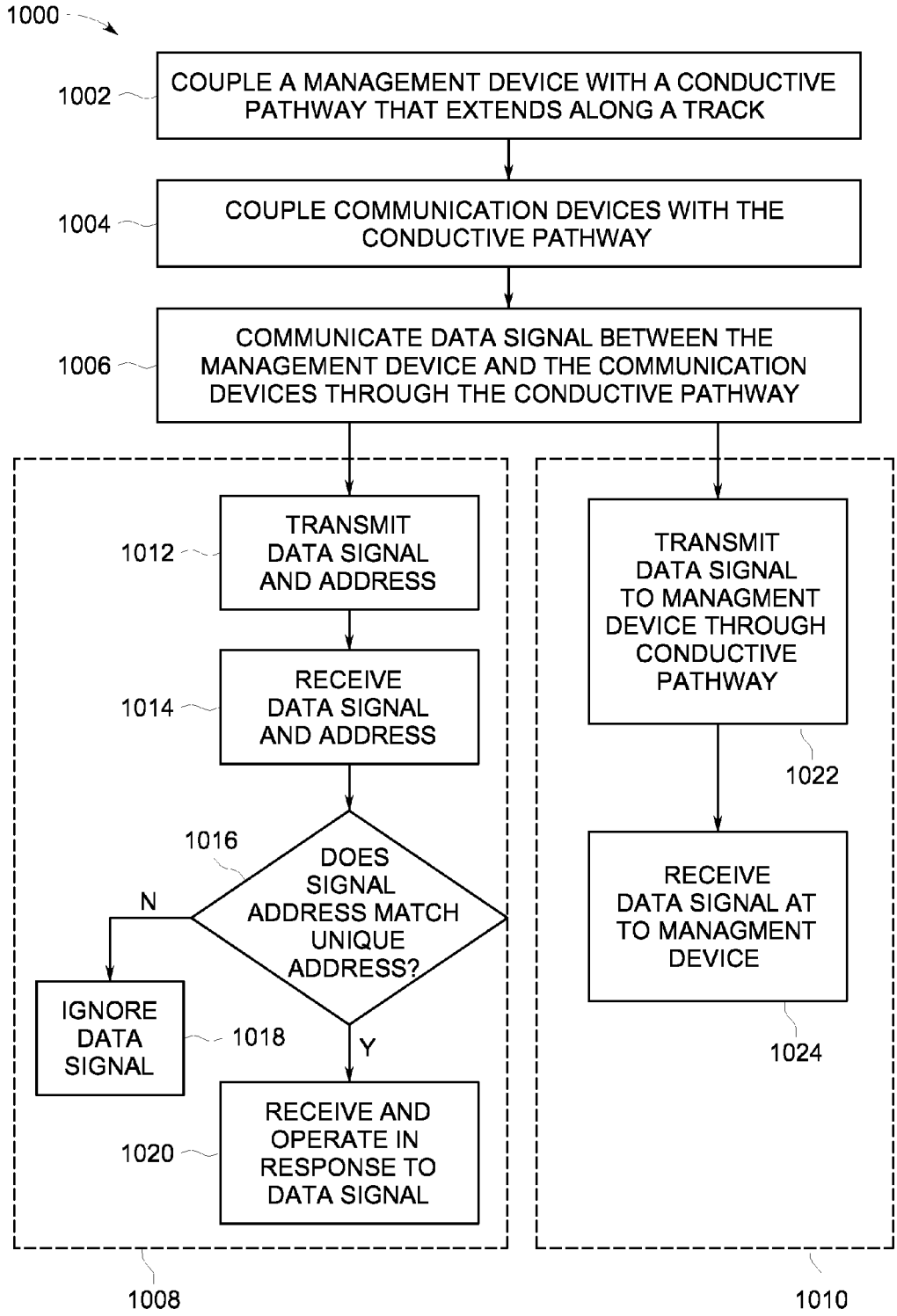
FIG. 10 is a flowchart of a method for communication with rail vehicles and/or rail appliances in accordance with one embodiment.

FIG. 10 is a flowchart of a method 1000 for communication with rail vehicles and/or rail appliances in accordance with one embodiment. The method 1000 may be used with one or more of the communication systems 100, 200, 500, 600, 700 (shown in FIGS. 1, 2, 5, 6, and 7) to communicate data signals between or among two or more of the management devices 112, 114, 116, 712, 714, 716 (shown in FIGS. 1 and 7), the rail vehicles 102, 104, 702 (shown in FIGS. 1 and 7), and/or the wayside equipment assemblies 106, 108, 110, 706 (shown in FIGS. 1 and 7). As described above, the data signals may be communicated through the conductive pathways 118, 718, 804, 904 (shown in FIGS. 1, 7, 8, and 9), such as the rails of the tracks 120 (shown in FIG. 1) and/or catenaries 718 (shown in FIG. 7). While the discussion herein focuses on the communication of data signals between a single management device 112, 114, 116, 712, 714, 716 and a single rail vehicle 102, 104, 702 or wayside equipment assembly 106, 108, 110, 706, alternatively the method 900 may be used to communicate data signals among more management devices 112, 114, 116, 712, 714, 716, rail vehicles 102, 104, 702, and/or wayside equipment assemblies 106, 108, 110, 706.

At 1002, the management device is coupled with a conductive pathway. For example, one or more of the management devices 112, 114, 116, 712, 714, 716 (shown in FIGS. 1 and 7) may be electrically coupled with the conductive pathways 118, 718, 804, 904 (shown in FIGS. 1, 7, 8, and 9). The conductive pathways may be rails of a track 120 (shown in FIG. 1) and/or catenaries 718 (shown in FIG. 7) that extend along the track 120.

At 1004, one or more communication devices are coupled with the conductive pathway. For example, the appliance communication devices 122, 722 (shown in FIGS. 1 and 7) that are coupled with the wayside equipment assemblies 106, 108, 110, 706 (shown in FIGS. 1 and 7) may be electrically coupled with the conductive pathways 118, 718, 804, 904 (shown in FIGS. 1, 7, 8, and 9). In another example, the on-board communication devices 506 (shown in FIG. 5) are coupled with the rail vehicles 102, 104, 702 (shown in FIGS. 1 and 7) and the conductive pathways 118, 718, 804, 904.

At 1006, a data signal is communicated between the management device and one or more of the communication devices. For example, one or more of the management devices 112, 114, 116, 712, 714, 716 (shown in FIGS. 1 and 7) may transmit a data signal to at least one of the appliance communication devices 122, 722 (shown in FIGS. 1 and 7) of the wayside equipment assemblies 106, 108, 110, 706 (shown in FIGS. 1 and 7) and/or the on-board communication devices 506 (shown in FIG. 5) of the rail vehicles 102, 104, 702 (shown in FIGS. 1 and 7). In one embodiment, the vehicle management device 114, 714 forms an instruction to control operations of one or more rail vehicles 102, 104, 702 that are remotely located from the vehicle management device 114, 714. Alternatively, at least one of the wayside equipment assemblies 106, 108, 110, 706 and/or the rail vehicles 102, 104, 702 may transmit a data signal to one or more of the management devices 112, 114, 116, 712, 714, 716.

Flow of the method 1000 proceeds along one of a plurality of paths 1008, 1010 depending on whether the data signal is communicated from a management device to a communication device, or vice-versa. If the data signal is transmitted from a management device to a communication device, flow of the method 1000 proceeds along the path 1008. Conversely, if the data signal is transmitted from a communication device to a management device, then flow of the method 1000 proceeds along the path 1010.

Along path 1008 and at 1012, the data signal and one or more unique addresses are transmitted through the conductive pathway. For example, the management device 112, 114, 116, 712, 714, and/or 716 (shown in FIGS. 1 and 7) may packetize the data signal with one or more unique addresses of the rail vehicles 102, 104, 702 (shown in FIGS. 1 and 7) and/or the wayside equipment assemblies 106, 108, 110, 706 (shown in FIGS. 1 and 7). The data signal is then transmitted through the conductive pathway 118, 718, 804, 904 (shown in FIGS. 1, 7, 8, and 9).

At 1014, the data signal and addresses are received by the rail vehicles 102, 104, 702 (shown in FIGS. 1 and 7) and/or the wayside equipment assemblies 106, 108, 110, 706 (shown in FIGS. 1 and 7). The data signal and addresses may be received by the communication devices 122, 506, 722 (shown in FIGS. 1, 5, and 7) that are coupled with the rail vehicles 102, 104, 702 or wayside equipment assemblies 106, 108, 110, 706.

At 1016, the address or addresses that are included with the data signal are compared to the unique addresses associated with the rail vehicles 102, 104, 702 (shown in FIGS. 1 and 7) and/or wayside equipment assemblies 106, 108, 110, 706 (shown in FIGS. 1 and 7) that are coupled to the conductive pathway 118, 718, 804, 904 (shown in FIGS. 1, 7, 8, and 9) through which the data signals are transmitted. If the address or addresses of the data signal (the "signal address" or "signal addresses") do not match or correspond with the address or addresses of the rail vehicles 102, 104, 702 and/or wayside equipment assemblies 106, 108, 110, 706 that received the data signal (the "unique address" or "unique addresses"), then flow of the method 1000 proceeds to 1018. Alternatively, if the signal address does match the unique address, then flow of the method 1000 proceeds to 1020.

At 1018, the data signal is received by rail vehicles 102, 104, 702 (shown in FIGS. 1 and 7) and/or wayside equipment assemblies 106, 108, 110, 706 (shown in FIGS. 1 and 7). As described above, in response to receiving the data signal, the rail vehicles 102, 104, 702 may change an operation, such as a throttle or brake setting, in response to an instruction included in the data signal. Alternatively, the rail vehicles 102, 104, 702 may store trip-related information that is included in the data signal. In another example, the wayside equipment assemblies 106, 108, 110, 706 may change a status or position in response to the data signal.

At 1020, the data signal is ignored by the rail vehicle 102, 104, 702 (shown in FIGS. 1 and 7) or wayside equipment assembly 106, 108, 110, 706 (shown in FIGS. 1 and 7 having addresses that do not match the signal address. For example, if the signal address of the data signal does not match the equipment address of the wayside equipment assembly 106, 108, or 110, then the data signal is not addressed to the wayside equipment assembly 106, 108, 110. As a result, the wayside equipment assembly 106, 108, 110 or the appliance communication device 122 (shown in FIG. 2) that is coupled to the wayside equipment assembly 106, 108, 110 ignores the data signal.

With respect to the transmission of a data signal through the conductive pathways 118, 718, 804, 904 (shown in FIGS. 1, 7, 8, and 9) from one or more of the rail vehicles 102, 104, 702 (shown in FIGS. 1 and 7) or wayside equipment assemblies 106, 108, 110, 706 (shown in FIGS. 1 and 7) to the management devices 112, 114, 116, 712, 714, and/or 716 (shown in FIGS. 1 and 7), in path 1010 and at 1022, the data signal is transmitted to the management device 112, 114, 116, 712, 714, and/or 716.

At 1024, the data signal is received at the management device 112, 114, 116, 712, 714, and/or 716 (shown in FIGS. 1 and 7). As described above, the management devices 112, 114, 116, 712, 714, and/or 716 may receive the data signal via the conductive pathway 118, 718, 804, 904 (shown in FIGS. 1, 7, 8, and 9). The data signal may represent a status of the rail vehicle 102, 104, 702 (shown in FIGS. 1 and 7), trip-related or archived information of the rail vehicle 102, 104, 702, and/or a status or position of the wayside equipment assembly 106, 108, 110, 706 (shown in FIGS. 1 and 7) that sent the data signal.

Alternatively, at 1024, unique addresses of the management devices 112, 114, 116, 712, 714, and/or 716 (shown in FIGS. 1 and 7) may be compared to a signal address of the data signal. If the unique address of a management device 112, 114, 116, 712, 714, and/or 716 matches or corresponds to the signal address, then the management device 112, 114, 116, 712, 714, and/or 716 receives the data signal. Otherwise, the management device 112, 114, 116, 712, 714, and/or 716 may ignore the data signal.

In one embodiment, a rail communication system includes: a communication management device capable of being communicatively coupled with a conductive pathway that extends along a track; and an on-board communication device capable of being coupled with a rail vehicle that travels along the track and with the conductive pathway, the communication management device and the on-board communication device configured to communicate a data signal between each other through the conductive pathway, wherein the data signal includes network data.

In another aspect, the conductive pathway includes at least one of a rail of the track along which the rail vehicle travels, a powered rail that supplies electric current to the rail vehicle, or a catenary supplying electric power to the rail vehicle.

In another aspect, the communication management device and the rail vehicle are configured to communicate the data signal between each other while the rail vehicle is moving along the track relative to the communication management device.

In another aspect, the communication management device is configured to transmit information related to an upcoming trip of the rail vehicle via the data signal to the on-board communication device.

In another aspect, the on-board communication device is configured to download operational information of the rail vehicle to the communication management device as the data signal, the operational information including a log of information related to a previous trip of the rail vehicle.

In another aspect, at least one of the communication management device or the on-board communication device is configured to transmit the data signal through the conductive pathway as a differential signal.

In another aspect, the communication management device and the on-board communication device are configured to transmit the data signal through the conductive pathway as one or more acoustic waves.

In another aspect, the on-board communication device is one of a plurality of on-board communication devices disposed on each of a plurality of different rail vehicles, the communication management device configured to transmit different data signals to different ones of the plurality of on-board communication devices based on locations of the different rail vehicles.

In another aspect, the communication management device is configured to communicate a plurality of the data signals in an order based on a priority of information included in the data signals.

In another aspect, the communication management device and the on-board communication device are configured to communicate the data signal over a plurality of different channels with at least one of the channels including the conductive pathway.

In another aspect, at least one of the communication management device or the on-board communication device is configured to switch transmission of a plurality of the data signals between the different channels to communicate the data signal based on one or more of transmission characteristics of the channels or a type of information included in the data signal.

In another embodiment, a method for communicating with rail vehicles includes: coupling a communication management device with a conductive pathway that extends alongside a track; and coupling an on-board communication device disposed on a rail vehicle that travels along the track with the conductive pathway; wherein the communication management device and the on-board communication device communicate a data signal through the conductive pathway and the data signal includes network data.

In another aspect, the steps of coupling the communication management device and coupling the on-board communication device include coupling the communication management device and the on-board communication device to the conductive pathway that includes at least one of a rail of the track along which the rail vehicle travels, a powered rail that supplies electric current to the rail vehicle, or a catenary supplying electric power to the rail vehicle.

In another embodiment, a method for communicating with a rail vehicle includes: transmitting a data signal from at least one of an on-board communication device disposed on the rail vehicle that travels along a track or a communication management device, wherein the data signal is transmitted over a conductive pathway that extends along the track, and wherein the data signal comprises network data; receiving the data signal at the other of the on-board communication device and the communication management device; and processing the data signal for one or more of management or control of movement of the rail vehicle along the track.

In another aspect, the transmitting step includes transmitting information related to an upcoming trip of the rail vehicle from the communication management device to the on-board communication device via the data signal.

In another aspect, the information related to the upcoming trip includes at least one of a throttle setting of the rail vehicle for the upcoming trip, a brake setting of the rail vehicle for the upcoming trip, information related to a route of the upcoming trip, a speed of the rail vehicle for the upcoming trip, or an update for one or more software applications of the rail vehicle.

In another aspect, the communicating step includes transmitting information related to a previous trip of the rail vehicle from the on-board communication device to the communication management device via the data signal.

In another aspect, the communicating step includes alternating which of a plurality of channels of the conductive pathway are used to transmit the data signal based on transmission characteristics of the channels.

In another embodiment, a rail communication system includes: a management device capable of being communicatively coupled with a conductive pathway that extends along a rail that a plurality of rail vehicles travel along; and a communication device capable of being coupled with the rail and at least one of a wayside equipment assembly or a rail vehicle, the management device and the communication device configured to communicate a data signal between each other and through the conductive pathway to at least one of change a status of the wayside equipment assembly, control an operation of the rail vehicle, or communicate trip related information with the rail vehicle, wherein the data signal comprises network data.

In another aspect, the communication device is capable of being communicatively coupled with at least one of a track switch, a track signal, or a rail vehicle monitoring apparatus and the management device is configured to transmit the data signal to at least one of change a position of the track switch, change a status of the track signal, or request a measurement obtained by the rail vehicle monitoring apparatus.

In another aspect, the communication device is capable of being disposed on the rail vehicle and coupled with a propulsion subsystem of the rail vehicle, the management device configured to remotely control the operation of the rail vehicle by transmitting instructions to the propulsion subsystem via the data signal.

In another aspect, the communication device is capable of being disposed on the rail vehicle and communicatively coupled with a computer readable storage medium of the rail vehicle, the management device configured to at least one of transmit upcoming trip-related information to the computer readable storage medium via the data signal or receive previous trip-related information from the computer readable storage medium via the data signal.

In one embodiment, a rail appliance communication system includes: an equipment management device capable of being coupled with a conductive pathway extending along a track that a rail vehicle travels along; and an appliance communication device capable of being coupled with a wayside equipment assembly disposed proximate to the track, the appliance communication device and the equipment management device configured to communicate a data signal with each other through the conductive pathway.

In another aspect, wherein the conductive pathway includes at least one of a rail of the track that the rail vehicle travels along, a powered rail that supplies electric current to the rail vehicle, or a catenary that supplies electric current to the rail vehicle.

In another aspect, the appliance communication device is coupled with at least one of a track switch, a track signal, or a rail vehicle monitoring apparatus.

In another aspect, the appliance communication device is coupled with a track switch and the data signal is communicated between the equipment management device and the appliance communication device to at least one of change or report a position of the track switch.

In another aspect, the appliance communication device is coupled with a track signal and the data signal is communicated between the equipment management device and the appliance communication device to at least one of change or report a status of the track signal.

In another aspect, the appliance communication device is coupled with a rail vehicle monitoring apparatus and the data signal is communicated between the equipment management device and the appliance communication device to at least one of measure or report a status of the rail vehicle that is measured by the rail vehicle monitoring apparatus.

In another aspect, the appliance communication device is configured to communicate diagnostic information related to a status of the wayside equipment assembly to the equipment management device as the data signal.

In another aspect, the appliance communication device is one of a plurality of appliance communication devices coupled with a plurality of the wayside equipment apparatuses, the equipment management device configured to communicate a plurality of the data signals with the plurality of appliance communication devices through the conductive pathway.

In another aspect, at least one of the equipment management device or the appliance communication device configured to communicate the data signal as a differential signal through the conductive pathway.

In another aspect, the appliance communication device is associated with a unique address and the equipment management device configured to transmit the data signal to the appliance communication device based on the unique addresses.

In another aspect, the conductive pathway includes a rail of the track that includes a plurality of rail segments that extend between opposite ends with neighboring rail segments being separated from each other by a gap, further comprising a bridge assembly configured to convey the data signal between the neighboring rail segments across the gap.

In another aspect, the equipment management device and the appliance communication device are configured to communicate the data signal as one or more acoustic waves that propagate through the conductive pathway In another embodiment, a method for communicating with a rail appliance includes: coupling an equipment management device with a conductive pathway that extends along a track that a rail vehicle travels along; and coupling an appliance communication device with the rail appliance, wherein the rail appliance is disposed proximate to the track; wherein the equipment management device and the appliance communication device communicate a data signal with each other through the conductive pathway.

In another aspect, the step of coupling the equipment management device with the conductive pathway includes coupling the equipment management device with at least one of a rail of the track, a powered rail that supplies electric current to the rail vehicle, or a catenary that supplies electric current to the rail vehicle.

In another aspect, the step of coupling the appliance communication device includes communicatively coupling the appliance communication device with at least one of a track switch, a track signal, or a rail vehicle monitoring apparatus.

In another aspect, the step of coupling the appliance communication device includes communicatively coupling the appliance communication device with a track switch and the equipment management device and the appliance communication device communicate the data signal to at least one of change or report a position of the track switch.

In another aspect, the step of coupling the appliance communication device includes communicatively coupling the appliance communication device with a track signal and the equipment management device and the appliance communication device communicate the data signal to at least one of change or report a status of the track signal.

In another aspect, the step of coupling the appliance communication device includes communicatively coupling the appliance communication device with a rail vehicle monitoring apparatus and the equipment management device and the appliance communication device communicate the data signal to at least one of measure or report a status of the rail vehicle that is measured by the rail vehicle monitoring apparatus.

In another embodiment, a rail appliance communication system includes: a first device configured to be coupled with a conductive pathway, the conductive pathway comprising one of a rail that a rail vehicle travels along, a rail that supplies electricity to the rail vehicle, or a catenary line that supplies electricity to the rail vehicle, wherein the first device comprises a network interface assembly for communicating data packets with a second device over the conductive pathway.

In another embodiment, a rail appliance communication system includes: an equipment management device capable of being coupled with a rail that a rail vehicle travels along; and a plurality of appliance communication devices capable of being electrically coupled with the equipment management device by the rail and capable of being coupled with a plurality of wayside equipment assemblies including one or more of a track switch, a track signal, or a rail vehicle monitoring apparatus disposed proximate to the rail, the appliance communication devices and the equipment management device configured to communicate a data signal among each other through the rail.

In another aspect, the data signal is communicated between the equipment management device and the appliance communication devices to at least one of change or report a position of the track switch, change or report a status of the track signal, or measure or report a status of the rail vehicle that is measured by the rail vehicle monitoring apparatus.

In another aspect, the equipment management device includes an operator interface configured to permit an operator to at least one of transmit input as the data signal or visually perceive output that is based on the data signal.

In one embodiment, a rail vehicle control communication system includes: a vehicle management device capable of being coupled with a conductive pathway extending along a track and of forming an instruction to control an operation of a rail vehicle travelling along the track, the vehicle management device transmitting the instruction to the rail vehicle through the conductive pathway; and an on-board communication device capable of being coupled with the rail vehicle, the on-board communication device configured to receive the instruction communicated through the conductive pathway from the vehicle management device, the on-board communication device configured to change the operation of the rail vehicle based on the instruction.

In another aspect, the conductive pathway includes at least one of a rail of the track that the rail vehicle travels along, a powered rail that supplies electric current to the rail vehicle, or a catenary that supplies electric current to the rail vehicle.

In another aspect, the vehicle management device is configured to communicate the instruction to the rail vehicle while the rail vehicle is moving along the track relative to the vehicle management device.

In another aspect, the on-board communication device is configured to direct a propulsion subsystem of the rail vehicle to change at least one of a tractive effort or a braking effort of the rail vehicle based on the instruction received through the conductive pathway.

In another aspect, the vehicle management device transmits the instruction as a differential signal through the conductive pathway.

In another aspect, the on-board communication device is associated with a unique address, the vehicle management device configured to communicate the instruction to the rail vehicle based on the unique address.

In another aspect, the conductive pathway is divided into segments extending between opposite ends separated by a gap, the vehicle management device configured to transmit the instruction to the rail vehicle based on which of the segments that the rail vehicle is traveling along.

In another aspect, the conductive pathway is divided into segments extending between opposite ends separated by a gap, further comprising a bridge assembly configured to convey the instruction between the neighboring segments across the gap.

In another aspect, the vehicle management device is configured to transmit the instruction to the rail vehicle through the conductive pathway while being remotely located from the rail vehicle.

In another aspect, the vehicle management device and the on-board communication device are configured to communicate the instruction as one or more acoustic waves that propagate through the conductive pathway In another embodiment, a method for communicating with a rail vehicle includes: forming an instruction to control operation of the rail vehicle travelling along a track; transmitting the instruction to the rail vehicle through a conductive pathway that extends along the track; and changing the operation of the rail vehicle based on the instruction.

In another aspect, the transmitting step comprises transmitting the instruction through at least one of a rail of the track, a powered rail that supplies electric current to the rail vehicle, or a catenary that supplies electric current to the rail vehicle.

In another aspect, the changing step includes varying at least one of a tractive effort or a braking effort of the rail vehicle based on the instruction.

In another aspect, the transmitting step includes communicating the instruction as a differential signal through the conductive pathway.

In another aspect, the forming step includes associating the instruction with a unique address of the rail vehicle and the changing step includes varying the operation of the rail vehicle if the instruction is associated with the unique address of the rail vehicle.

In another aspect, the conductive pathway includes segments that extend between opposite ends with neighboring segments being separated from each other by a gap, and the transmitting step includes transmitting the instruction to the rail vehicle based on which of the segments that the rail vehicle is traveling along.

In another aspect, the conductive pathway includes segments that extend between opposite ends with neighboring segments being separated from each other by a gap, and the method further includes conveying the instruction between the neighboring segments across the gap.

In another embodiment, a rail vehicle control communication system includes: a communication device capable of being coupled with a propulsion subsystem of a rail vehicle and capable of being coupled with a rail that the rail vehicle travels along; and a vehicle management device capable of being coupled with the rail and configured to communicate a data signal through the rail to the communication device, the data signal controlling the propulsion subsystem to change at least one of a tractive effort or a braking effort of the rail vehicle.

In another aspect, the system includes a plurality of the communication devices each associated with a different address, the vehicle management device configured to independently control a plurality of the rail vehicles based on the different addresses.

In another aspect, the system further includes a mobile management device communicatively coupled with and capable of moving relative to the vehicle management device, the mobile management device generating the data signal that controls the propulsion subsystem of the rail vehicle.

In another aspect, the mobile management device is configured to wirelessly communicate the data signal to the vehicle management device.

In any of the embodiments herein, the data transmitted over the conductive pathway (e.g., track rail), such as an instruction from a vehicle management device to an on-board communication device, may be "high bandwidth" data, meaning data transmitted at average rates of 10 Mbit/sec or greater. ("High bandwidth network data" is data that is packaged in packet form as data packets and transmitted over the conductive pathway at average rates of 10 Mbit/sec or greater.)

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the invention, including the best mode, and also to enable any person skilled in the art to practice the embodiments disclosed herein, including making and using any devices or systems and performing any incorporated methods. The patentable scope of the subject matter is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the disclosed subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described systems and methods for communicating data through conductive pathways that extend along the tracks that rail vehicles travel along, without departing from the spirit and scope of the subject matter herein involved, it is intended that all of the subject matter of the above description or shown in the accompanying drawings shall be interpreted merely as examples illustrating the inventive concepts herein and shall not be construed as limiting the disclosed subject matter.

What is claimed is:

1. A rail communication system comprising:

a communication management device capable of being communicatively coupled with a conductive pathway that extends along a track; and plural on-board communication devices capable of being coupled with plural respective rail vehicles that travel along the track and with the conductive pathway, the communication management device and the on-board communication devices configured to communicate data signals between one another through the conductive pathway, wherein the data signal comprises network data, the communication management device configured to transmit different data signals to different ones of the on-board communication devices based on locations of the different rail vehicles.

2. The rail communication system of claim 1, wherein the conductive pathway includes at least one of a rail of the track along which the rail vehicles travel, a powered rail that supplies electric current to the rail vehicles, or a catenary supplying electric power to the rail vehicles.

3. The rail communication system of claim 1, wherein the communication management device and the rail vehicles are configured to communicate the data signal between each other while the rail vehicles are moving along the track relative to the communication management device.

4. The rail communication system of claim 1, wherein the communication management device is configured to transmit information related to an upcoming trip of one or more of the rail vehicles via the data signals to the on-board communication device of the one or more of the rail vehicles.

5. The rail communication system of claim 1, wherein the on-board communication devices are configured to download operational information of the respective rail vehicles from the respective rail vehicles to the communication management device as the data signals, the operational information including a log of information related to a previous trip of the respective rail vehicle.

6. The rail communication system of claim 1, wherein the communication management device and the on-board communication devices are configured to transmit the data signals through the conductive pathway as one or more acoustic waves.

7. The rail communication system of claim 1, wherein the communication management device and the on-board communication devices are configured to communicate the data signals over a plurality of different channels with at least one of the channels including the conductive pathway.

8. The rail communication system of claim 7, wherein at least one of the communication management device or the on-board communication devices is configured to switch transmission of a plurality of the data signals between the different channels to communicate the data signals based on one or more of transmission characteristics of the channels or a type of information included in the data signal.

9. The rail communication system of claim 1, wherein the network data is packetized data that includes address fields and one or more data fields, the address fields indicating at least one of a transmitter or receiver of the packetized data, the data fields representing at least one of information or instructions communicated in the packetized data.

10. A rail communication system comprising:

a communication management device capable of being communicatively coupled with a conductive pathway that extends along a track; and an on-board communication device capable of being coupled with a rail vehicle that travels along the track and with the conductive pathway, the communication management device and the on-board communication device configured to communicate a data signal between each other through the conductive pathway, wherein the data signal comprises network data, wherein the communication management device is configured to communicate a plurality of the data signals in an order based on a priority of information included in the data signals.

11. A method for communicating with a rail vehicle, the method comprising:

coupling a communication management device with a conductive pathway that extends alongside a track; and coupling an on-board communication device disposed on the rail vehicle that travels along the track with the conductive pathway, the on-board communication device coupled with a propulsion subsystem of the rail vehicle;

wherein the communication management device and the on-board communication device communicate a data signal through the conductive pathway that remotely controls operation of the rail vehicle by transmitting instructions to the propulsion subsystem via the data signal, and wherein the data signal comprises network data.

12. The method of claim 11, wherein the steps of coupling the communication management device and coupling the on-board communication device include coupling the communication management device and the on-board communication device to the conductive pathway that includes at least one of a rail of the track along which the rail vehicle travels, a powered rail that supplies electric current to the rail vehicle, or a catenary supplying electric power to the rail vehicle.

13. A method for communicating with a rail vehicle, the method comprising:

transmitting a data signal from at least one of an on-board communication device disposed on the rail vehicle that travels along a track or a communication management device, wherein the data signal is transmitted over a conductive pathway that extends along the track and that includes plural channels used to transmit the data signal, and wherein the data signal comprises network data;

receiving the data signal at the other of the on-board communication device and the communication management device; and processing the data signal for one or more of management or control of movement of the rail vehicle along the track wherein the transmitting step includes changing which of the plural channels of the conductive pathway are used to transmit the data signal based on transmission characteristics of the channels.

14. The method of claim 13, wherein the transmitting step includes transmitting information related to an upcoming trip of the rail vehicle from the communication management device to the on-board communication device via the data signal.

15. The method of claim 14, wherein the information related to the upcoming trip includes at least one of a throttle setting of the rail vehicle for the upcoming trip, a brake setting of the rail vehicle for the upcoming trip, information related to a route of the upcoming trip, a speed of the rail vehicle for the upcoming trip, or an update for one or more software applications of the rail vehicle.

16. The method of claim 13, wherein the transmitting step includes transmitting information related to a previous trip of the rail vehicle from the on-board communication device to the communication management device via the data signal.

17. A rail communication system comprising:

a management device capable of being communicatively coupled with a conductive pathway that extends along a rail that a plurality of rail vehicles travel along; and a communication device capable of being coupled with the rail and at least one of a wayside equipment assembly or a rail vehicle, the management device and the communication device are configured to communicate a data signal between each other and through the conductive pathway to at least one of change a status of the wayside equipment assembly, control an operation of the rail vehicle, or communicate trip related information with the rail vehicle, wherein the data signal comprises network data wherein the communication device is capable of being disposed on the rail vehicle and coupled with a propulsion subsystem of the rail vehicle, the management device configured to remotely control the operation of the rail vehicle by transmitting instructions to the propulsion subsystem via the data signal.

18. The rail communication system of claim 17, wherein the communication device is capable of being communicatively coupled with at least one of a track switch or a track signal, and the management device is configured to transmit the data signal to at least one of change a position of the track switch or change a status of the track signal.

19. The rail communication system of claim 17, wherein the communication device is capable of being disposed on the rail vehicle and communicatively coupled with a computer readable storage medium of the rail vehicle, the management device configured to at least one of transmit upcoming trip-related information to the computer readable storage medium via the data signal or receive previous trip-related information from the computer readable storage medium via the data signal.

* * * * *

UNITED STATES PATENT AND TRADEMARK OFFICE

CERTIFICATE OF CORRECTION

PATENT NO. : 8,423,208 B2
APPLICATION NO. : 12/891925
DATED : April 16, 2013
INVENTOR(S) : Daum et al.

It is certified that error appears in the above-identified patent and that said Letters Patent is hereby corrected as shown below:

In the Claims

In Column 34, Line 44, in Claim 17, delete "data" and insert -- data, --, therefor.

Signed and Sealed this
Thirteenth Day of August, 2013

Teresa Stanek Rea
*Acting Director of the United States Patent and Trademark Office*